US008670014B2

(12) United States Patent
Shoji et al.

(10) Patent No.: US 8,670,014 B2
(45) Date of Patent: Mar. 11, 2014

(54) IMAGE FORMING APPARATUS

(75) Inventors: Ryuhei Shoji, Suntou-gun (JP); Hironobu Nihei, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 12/946,336

(22) Filed: Nov. 15, 2010

(65) Prior Publication Data

US 2011/0129244 A1 Jun. 2, 2011

(30) Foreign Application Priority Data

Nov. 30, 2009 (JP) ..... 2009-272800
Nov. 2, 2010 (JP) ..... 2010-246745

(51) Int. Cl.
*B41J 2/435* (2006.01)
*B41J 2/47* (2006.01)

(52) U.S. Cl.
USPC ..... 347/235; 347/250

(58) Field of Classification Search
USPC ..... 347/116, 229, 234, 235, 243, 248–250, 347/259–260; 399/70, 301, 302, 66, 399/297–299, 308
See application file for complete search history.

(56) References Cited

U.S. PATENT DOCUMENTS

| | | | | |
|---|---|---|---|---|
| 5,499,092 | A * | 3/1996 | Sasaki | 399/302 |
| 5,697,031 | A * | 12/1997 | Kamiya et al. | 399/301 |
| 6,049,351 | A * | 4/2000 | Noguchi et al. | 347/249 |
| 6,184,910 | B1 * | 2/2001 | Sasaki et al. | 347/116 |
| 6,256,461 | B1 * | 7/2001 | Takeyama et al. | 399/66 |
| 6,336,024 | B1 * | 1/2002 | Kanaya et al. | 399/301 |
| 7,499,066 | B2 * | 3/2009 | Takeyama et al. | 347/116 |
| 7,502,041 | B2 * | 3/2009 | Suzuki et al. | 347/116 |
| 7,583,919 | B2 * | 9/2009 | Suzuki et al. | 399/301 |
| 2004/0036761 | A1 * | 2/2004 | Bannai | 347/243 |

FOREIGN PATENT DOCUMENTS

JP 9-290534 A 11/1997

* cited by examiner

*Primary Examiner* — Hai C Pham
(74) *Attorney, Agent, or Firm* — Fitzpatrick, Cella, Harper & Scinto

(57) ABSTRACT

This invention has as its object to improve an image formation throughput. An image forming apparatus of this invention times a time required until an image formation is ready to start after a reference signal is output, and executes the image formation when the image formation is ready to start (for example, initial processes are complete). Furthermore, when the next reference signal is output during the image formation, the image forming apparatus executes an image formation of the next color after a waiting process based on the timed time.

15 Claims, 18 Drawing Sheets

IMAGE FORMING APPARATUS

BACKGROUND OF THE INVENTION

1. Field of the Invention

The present invention relates to an image forming apparatus which includes a single image carrier and a plurality of developers, and forms a color image.

2. Description of the Related Art

A color image forming apparatus, which includes a single photosensitive member (image carrier) and developers corresponding to the number of colors of developing agents, adopts, for example, a color image forming method (to be referred to as a rotary method hereinafter) which repetitively executes image forming cycles as many as the number of colors of the developing agents.

In the rotary method, since developed images of respective colors are required to be overlaid on each other on a belt- or drum-shaped transfer member used to perform primary transfer of images, one or more marks serving as reference positions are arranged on the transfer member. Therefore, the rotary method is able to overlay developed images on the transfer member by starting image formations with reference to a detection signal of these marks by a sensor (to be referred to as a transfer belt reference signal hereinafter).

In the control of the conventional rotary method, when the image forming apparatus receives a print request from, for example, a PC, preparation operations for, for example, activating a scanner motor, transfer belt, and photosensitive member are performed. Furthermore, in the preparation operations, print image data is rasterized to raster image data to allow to form electrostatic latent images by means of light beams. After completion of the preparation operations, upon reception of the transfer belt reference signal, an output enable signal of the raster image data is output after an elapse of a predetermined time period, and image data is output from an image controller in synchronism with a BD signal. After that, formation of a latent image, development, and transfer processing are repetitively executed as many as the number of developing colors according to image data, thereby forming a color image as the developing agent images of the respective developing colors are overlaid on each other on the transfer belt. Such control of the rotary method is disclosed in, for example, Japanese Patent Laid-Open No. 09-290534.

In recent color printers, higher throughputs are demanded. As described above, in the image forming apparatus of the conventional rotary method, the transfer belt reference signals have to be received so as to overlay toner images of respective colors to have a precise positional relationship. However, when the marks pass through the sensor immediately before completion of initialization operations, they are detected at a delayed timing, thus delaying the start of print processing.

SUMMARY OF THE INVENTION

The present invention enables realization of an improvement of an image formation throughput in an image forming apparatus of, for example, a rotary method.

One aspect of the present invention provides an image forming apparatus comprising: an image forming unit that includes a rotation member which is used in an image formation, and on which a mark indicating a reference position for the image formation is formed;

a detection unit that detects the mark of the rotating rotation member and outputs a reference signal; a control unit that controls the image forming unit to execute the image formation when the image formation is ready to start after the reference signal is output; and a timing unit that times a time after the reference signal is output until the image formation is ready to start, wherein when the next reference signal is output, the control unit controls the image forming unit to execute an image formation of a next color after a waiting process based on a time timed by the timing unit.

Further features of the present invention will be apparent from the following description of exemplary embodiments with reference to the attached drawings.

DESCRIPTION OF THE EMBODIMENTS

Figure 1:
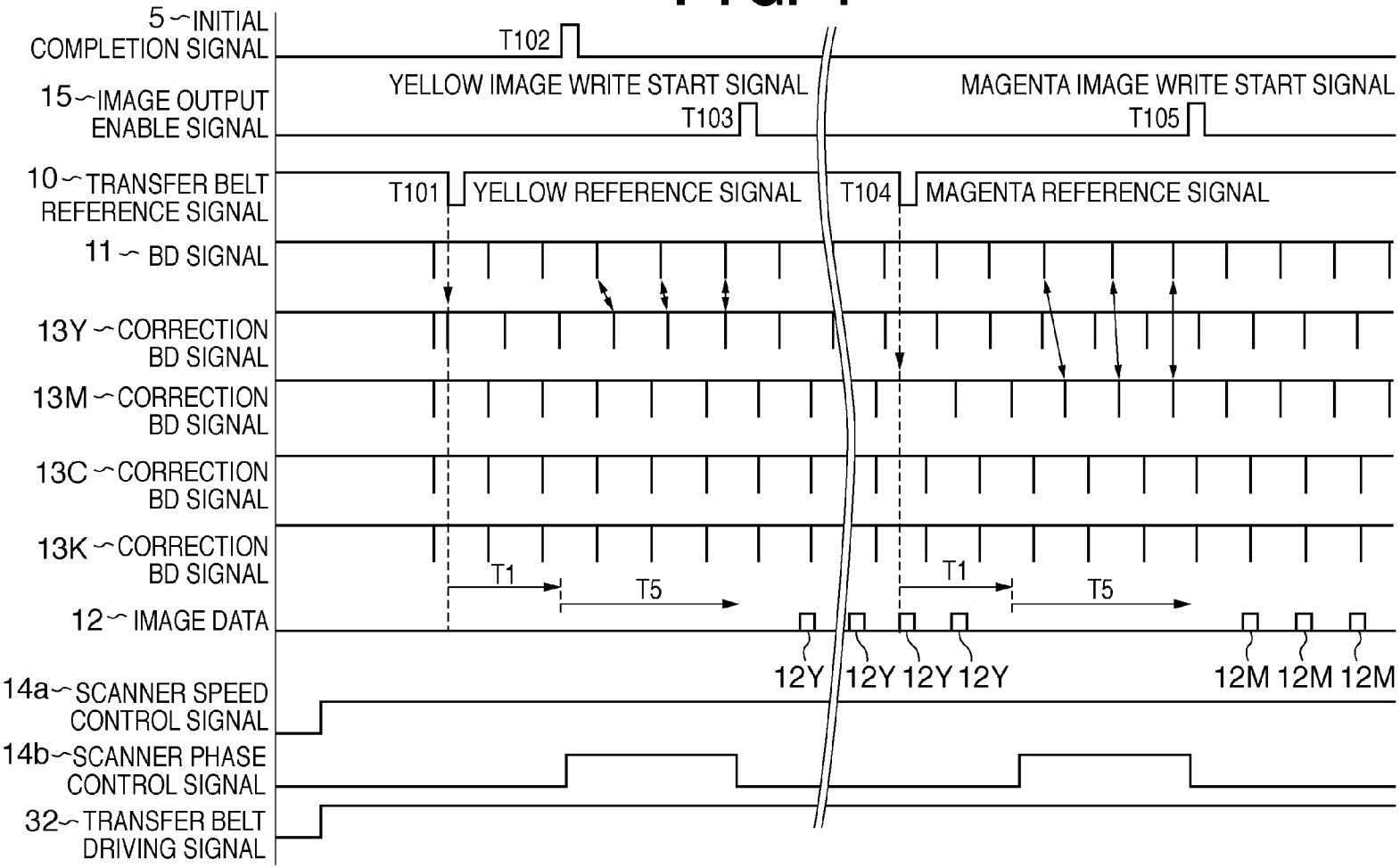
FIG. 1 is a timing chart showing the timings of respective signals in scanner control.
Figure 2:
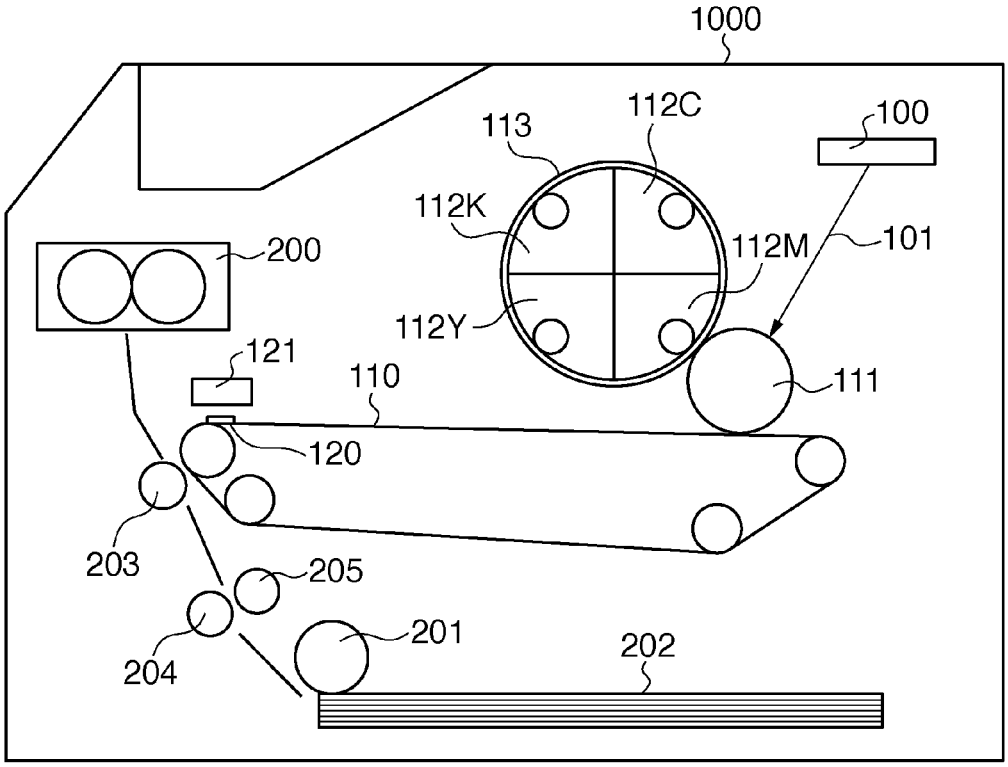
FIG. 2 is a sectional view showing an example of the arrangement of an image forming apparatus 1000.

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Arrangement of Image Forming Apparatus

The first embodiment will be described hereinafter with reference to FIGS. 1 to 6B. An image forming apparatus according to this embodiment includes a correction BD signal output unit which outputs correction BD signals for respective developing colors in response to reception of transfer belt reference signals at the time of execution of print processing. After completion of activations of respective driving systems (a scanner, transfer belt, and developers) and output preparations of raster image data, the image forming apparatus corrects a rotational phase of the scanner based on the correction BD signals corresponding to the developing colors, and starts image formations. The arrangement of an image forming apparatus 1000 according to this embodiment will be described first with reference to FIG. 2. Note that Y, M, C, and K in FIG. 2 respectively represent Yellow, Magenta, Cyan, and Black colors.

The image forming apparatus 1000 includes a laser scanner unit (light beam generation unit) 100, photosensitive drum (image carrier) 111, developers 112Y, 112M, 112C, and 112K, rotary developer holding unit 113, transfer belt (intermediate transfer member) 110, reference position mark 120, reference position detection sensor 121, pickup roller 201, transfer roller 203, convey rollers 204 and 205, and fixing device 200. The laser scanner unit 100 outputs a laser beam (light beam) 101 according to image data. On the photosensitive drum 111, an electrostatic latent image is formed on its surface (on a single image carrier) by the laser beam 101. The developers 112Y, 112M, 112C, and 112K respectively hold toners (developing agents) of respective developing colors, and apply the toners to electrostatic latent images. The rotary developer holding unit 113 is a developing unit which holds the respective developers 112 to allow development of the respective developing colors for the single photosensitive drum 111 when it is rotated. On the transfer belt 110, the developed images (developing agent images) developed on the photosensitive drum 111 are primary-transferred. The reference position mark 120 is provided to detect a reference position of the transfer belt 110. The reference position detection sensor 121 optically detects the reference position mark 120. The transfer roller 203 transfers the image transferred on the transfer belt 110 onto a print sheet 202. The pickup roller 201 picks up paper sheets one by one from a paper cassette. The convey rollers 204 and 205 guide the print sheet 202 to the transfer roller 203. The fixing device 200 melts and fixes the toners transferred on the print sheet 202.

<Control Arrangement of Image Forming Apparatus>

Figure 3:
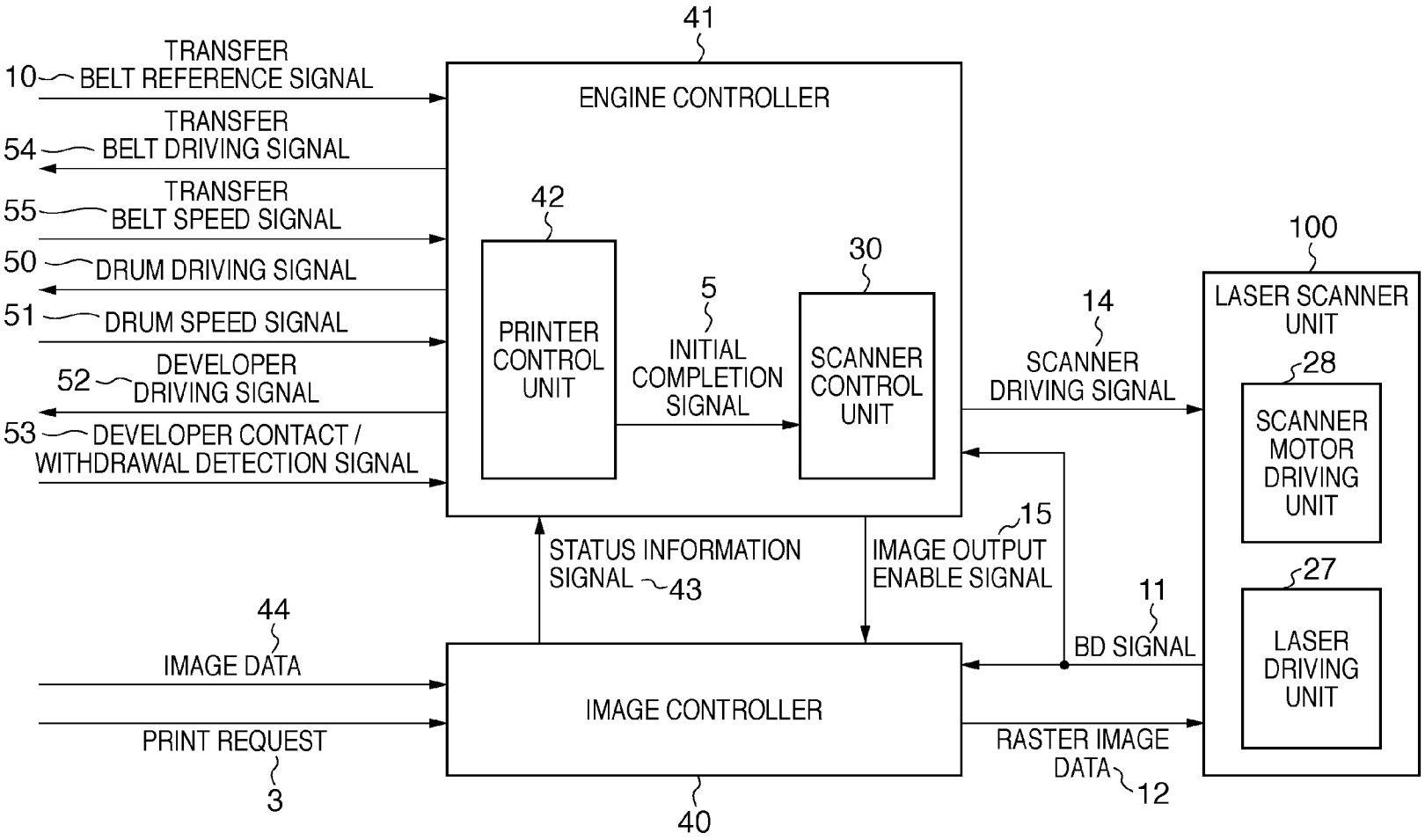
FIG. 3 is a block diagram showing an example of the control arrangement of the image forming apparatus 1000.

A print control system according to this embodiment will be described below with reference to FIG. 3. The image forming apparatus 1000 includes, as the control arrangement, an image controller 40 and engine controller 41. The engine controller 41 includes a scanner control unit 30 and printer control unit 42. The image controller 40 serves as a data input unit. The image controller 40 receives a print request 3 and image data 44 from, for example, a PC, and transmits raster image data to the laser scanner unit 100. The engine controller 41 executes actuator control and status management on a printer.

The printer control unit 42 receives various print requests transmitted from the image controller 40, and controls to activate and stop actuators of the transfer belt 110, photosensitive drum 111, rotary developer holding unit 113, and the like in response to the requests. The scanner control unit 30 controls a scanner motor in the laser scanner unit 100 so as to output, at predetermined timings, BD signals 11 as output synchronization signals of raster image data transmitted from the image controller 40. That is, the BD signals 11 indicate main scanning synchronization signals required for the scanner to scan (start to emit) laser beams. Note that a scanner motor driving unit 28 and laser driving unit 27 in the laser scanner unit 100 will be described later using FIG. 4.

<Arrangement of Laser Scanner Unit>

Figure 4:
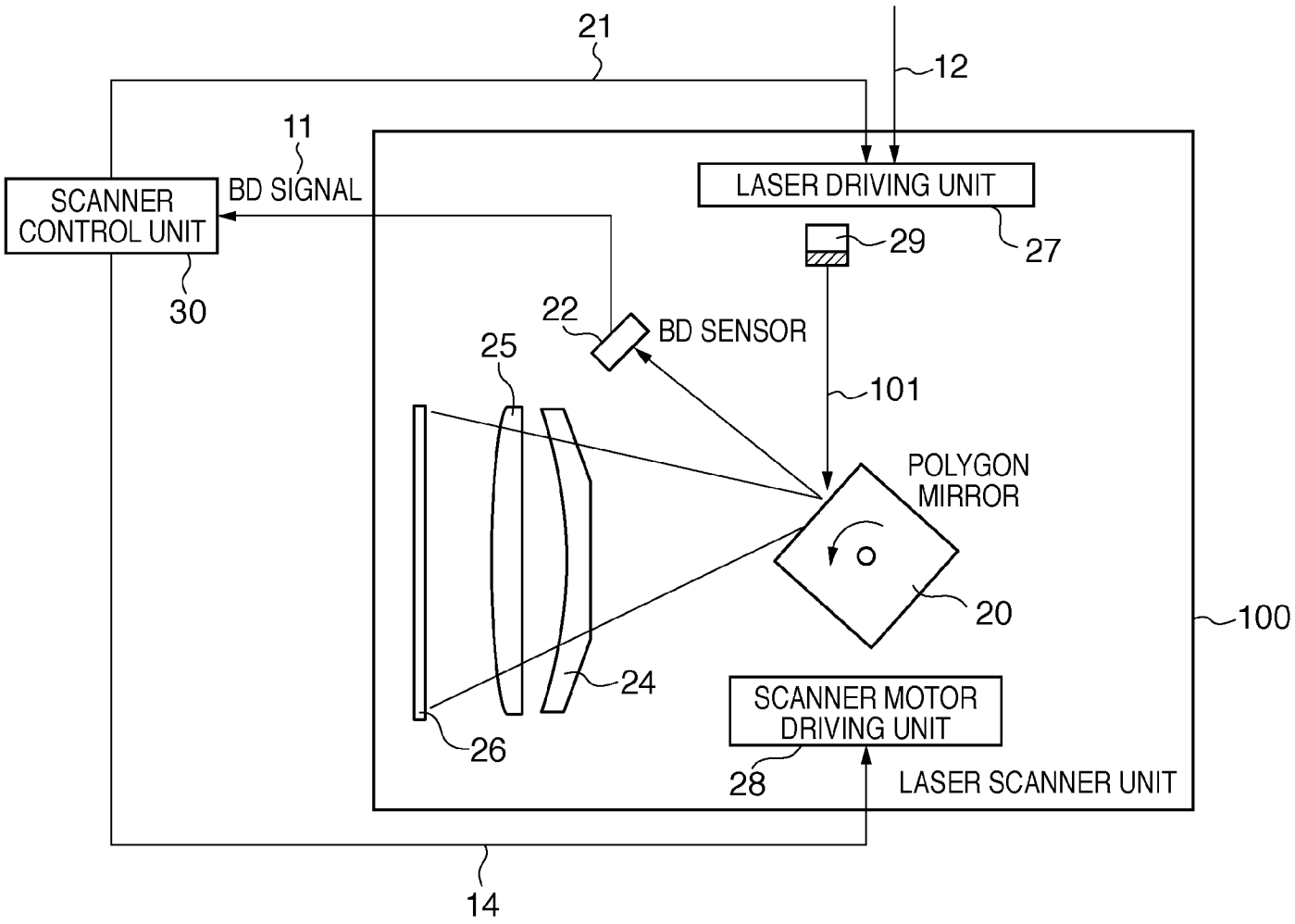
FIG. 4 is a view showing an example of the arrangement of a laser scanner unit 100.

The arrangement of the laser scanner unit 100 according to this embodiment will be described below with reference to FIG. 4. The laser scanner unit 100 includes a semiconductor laser 29, polygon mirror (rotating polygonal mirror) 20, laser beam detection sensor 22 (to be referred to as a BD sensor 22 hereinafter), f-θ lenses 24 and 25, reflecting mirror 26, laser driving unit 27, and scanner motor driving unit 28. The laser scanner unit 100 deflects and scans light beams.

The semiconductor laser 29 has a laser light source, and irradiates the polygon mirror 20 with the laser beam 101. The polygon mirror 20 deflects the laser beam 101 oscillated by the semiconductor laser 29. The BD sensor 22 serves as a main scanning synchronization signal output unit, and is arranged on a scan line of the deflected laser beam 101. The BD sensor 22 detects irradiation of the laser beam 101, and outputs the BD signal 11 to the scanner control unit 30. The f-θ lenses 24 and 25 correct the scan speed of the laser beam 101 deflected by the polygon mirror 20 on the photosensitive drum 111 to a constant speed. The reflecting mirror 26 reflects the speed-corrected laser beam 101 toward the photosensitive drum 111.

The laser driving unit 27 executes light emission control of the semiconductor laser 29 serving as a light beam generation unit. The scanner motor driving unit 28 controls the rotational speed and rotational phase of the polygon mirror 20. Reference numeral 14 denotes a control signal with which the scanner control unit 30 issues an acceleration/deceleration instruction to the scanner motor driving unit 28. Reference numeral 21 denotes a control signal with which the scanner control unit 30 issues a light emission/extinction instruction of the semiconductor laser to the laser driving unit 27. Reference numeral 12 denotes raster image data transmitted from the image controller 40.

The scanner control unit 30 executes control for rotating the polygon mirror 20 at speeds according to various print requests at the time of image formation. More specifically, the scanner control unit 30 executes speed adjustment of the scanner motor so that the detection period of the BD signals 11 transmitted from the BD sensor 22 (that is, the rotational speed of the scanner motor) matches a predetermined period. Also, in order to realize accurate overlaying of respective colors, the scanner control unit 30 corrects the rotational phase of the polygon motor 20 so as to detect the BD signals 11 at desired timings. More specifically, the scanner control unit 30 generates a correction BD signal as a correction signal, and controls the polygon mirror 20 so that a time difference between the generated correction BD signal and the BD signal 11 becomes zero (these signals match). As a result, the phase of the BD signal 11 is corrected. That is, the rotational phase correction of the polygon mirror 20 with respect to the correction BD signal as a reference is synonymous with the phase correction of the BD signal 11 with respect to the correction BD signal as a reference.

Upon reception of a print request from, for example, a PC, the image forming apparatus 1000 executes preparation processes (to be also referred to as initial processes hereinafter). Examples of the initial processes are enumerated below.

Initial rotation control required to move the developers in the rotary developer holding unit 113 to predetermined positions Activation (rotation) control of the polygon mirror 20

Activation (rotation) control of the photosensitive drum 111

Activation control of the transfer belt 110

Temperature adjustment control of the fixing device 200

Voltage application (charging) control to the photosensitive drum 111

Transfer voltage control to the transfer belt 110

Times required for these initial processes vary depending on an apparatus environment such as an apparatus temperature, a print mode difference (color or monochrome print mode), and the like every time these processes are executed. Such variations are caused since a time required for temperature adjustment before image formation varies depending on the apparatus temperature or the temperature of the fixing device before image formation. Such variations are also caused since a time required to move the developer held in the rotary developer holding unit to a position adjacent to the photosensitive drum varies due to the first color to be developed changes depending on a difference of the color or monochrome print mode. Upon completion of the predetermined preparation operations (initial processes, initial operations), the image forming apparatus 1000 executes the rotational phase control of the laser scanner motor with reference to the transfer belt reference signal 10. The rotational phase control of the laser scanner motor will be simply referred to as phase control hereinafter.

After that, the image forming apparatus 1000 controls the semiconductor laser 29 to emit light according to raster image data transmitted from the image controller 40, and sequentially executes formation of a latent image on the photosensitive drum 111, image formation, and image transfer onto the transfer belt 110. These processes are repetitively executed as many as the number of developers, and the print sheet 202 is fed from the paper cassette to the transfer roller 203. After that, image transfer onto the print sheet 202 and image fixing are sequentially executed, and the printed print sheet 202 is discharged onto a paper discharge unit.

<Arrangement of Scanner Control Unit>

Figure 5:
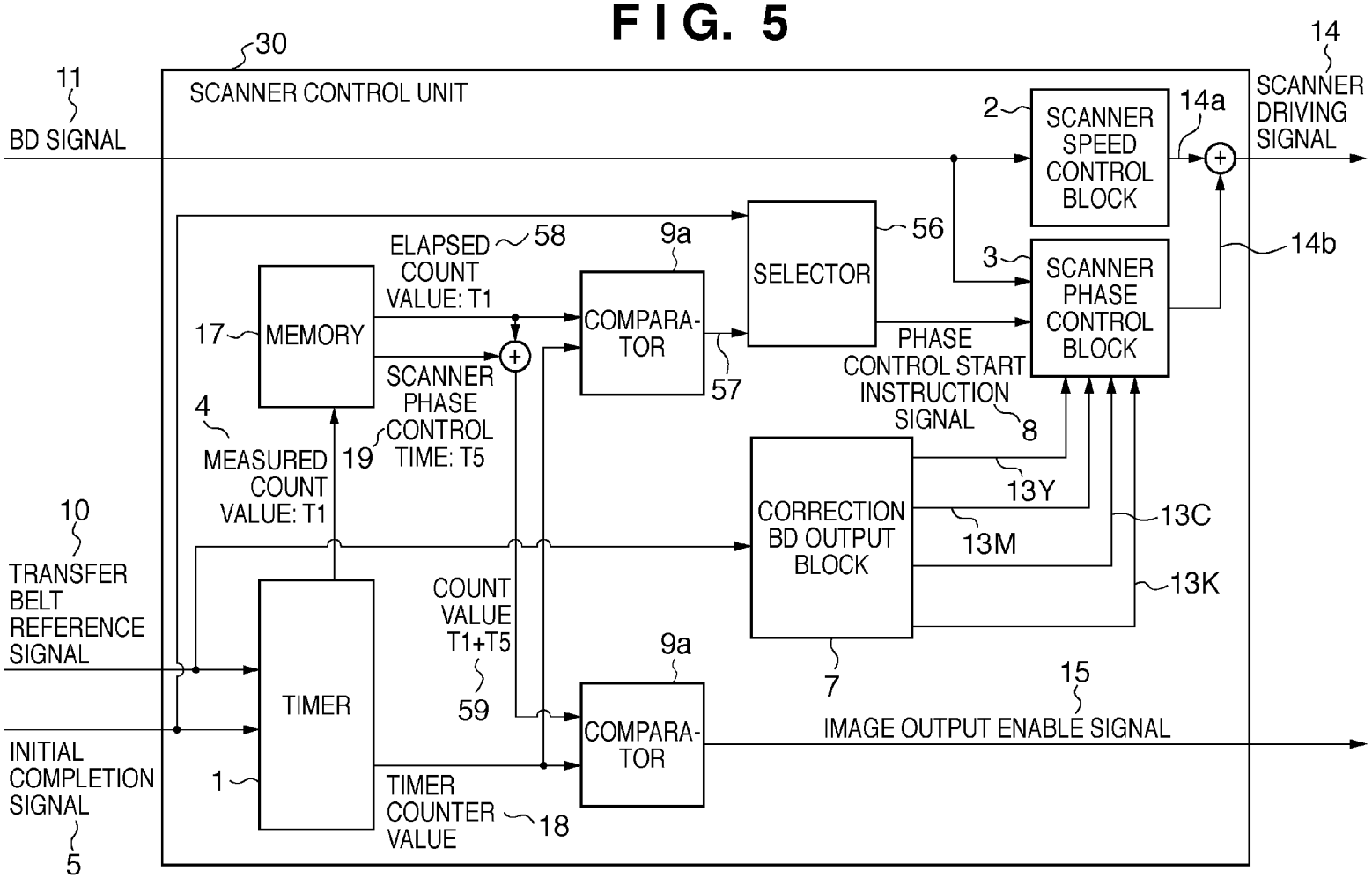
FIG. 5 is a block diagram showing an example of the arrangement of a scanner control unit 30.

The control of the laser scanner unit 100 according to this embodiment will be described below with reference to FIG. 5. The scanner control unit 30 includes a timer 1, comparators 9*a* and 9*b*, memory 17, correction BD output block 7, selector 56, scanner phase control block 3, and scanner speed control block 2. Reference numeral 10 denotes a pulse-shaped transfer belt reference signal that is transmit from the reference position detection sensor 121 when the reference position mark 120 of the transfer belt 110 is detected. Reference numeral 5 denotes a pulse-shaped initial completion signal transmitted when the printer control unit 42 determines that the preparation operations including activations of respective driving sources and image rasterization are complete, and image formation is ready to start. The timer 1 times a time with reference to reception of the transfer belt reference signal, and stores an elapsed time T1 from reception of the transfer belt reference signal 10 until reception of the initial completion signal 5 in the memory 17 as count data 4. The memory 17 stores the count data 4 transmitted from the timer 1 and data indicating a predetermined time T5 required for phase control of the scanner motor.

The comparator 9*a* discriminates whether or not count data 58 which is stored in the memory 17 and indicates the elapsed time T1 from reception of the transfer belt reference signal 10 until reception of the initial completion signal matches a counter value 18 which is transmitted from the timer 1 and is set with reference to the transfer belt reference signal 10. When these data match, the comparator 9*a* transmits a pulse signal 57 to the selector 56. The comparator 9*b* discriminates whether or not a count value 59 as a sum of the count data 58 and count data as the time T5 required for the phase control of the scanner motor matches the counter value 18. If these values match, the comparator 9*b* outputs an image output enable signal 15 as an output start instruction of raster image data to the image controller 40.

The correction BD output block 7 outputs each of correction BD signals 13Y, 13M, 13C, and 13K for respective colors with reference to a timing after an elapse of the time T1 since the transfer belt reference signal 10, and informs the scanner phase control block 3 of these signals. That is, the correction BD output block 7 serves as an output unit common to a plurality of developing colors. The selector 56 selectively informs the scanner phase control block 3 of the initial completion signal 5 at the time of a Y print process and of the pulse signal 57 at the time of M, C, and K print processes as a scanner phase control start instruction signal 8. The scanner speed control block 2 calculates the rotational speed of the scanner motor based on the detection period of the BD signals 11 transmitted from the laser scanner unit 100, and executes acceleration/deceleration control (driving control) of the scanner motor to attain rotational speeds according to various print requests. The scanner phase control block 3 executes acceleration/deceleration control of the scanner motor from the reception timing of the phase control start instruction signal 8 of the scanner motor, so that a reception time difference between each of the correction BD signals 13Y, 13M, 13C, and 13K and the BD signal 11 becomes zero (that is, a phase difference becomes zero).

<Scanner Control Timing Chart>

The timings of respective signals upon execution of the laser scanner control according to this embodiment will be described below with reference to FIG. 1. Upon reception of a print request, the image forming apparatus 1000 starts activations of various actuators and raster image data generation processing first. More specifically, the activations of various actuators are done by, for example, activating a scanner speed control signal 14*a* to "H" and a transfer belt-driving signal 32 to "H".

After the speed of the transfer belt 110 stabilizes, when the transfer belt reference signal 10 is received at a timing T101, the correction BD output block 7 clears the Y correction BD signal, and outputs a new correction BD signal with reference to reception of the transfer belt reference signal 10. After that, when the preparation operations required to start image formation are complete, the printer control unit 42 transmits the initial completion signal 5 to the scanner control unit 30 at a timing T102. Note that in the aforementioned initial processes, an interval between the transfer belt reference signal 10 and initial completion signal 5 may always vary depending on the time required for the initial processes themselves and the stop position of the transfer belt 110 (that of the reference position mark 120).

When the initial completion signal 5 is transmitted to the scanner control unit 30, the scanner control unit 30 stores an elapsed time T1 from the timing T101 until the timing T102 in the memory 17. At the same time, the scanner control unit 30 transmits the phase control start instruction signal 8 to the scanner phase control block 3. In response to this signal, the scanner phase control block 3 starts the scanner phase correction based on the Y correction BD signal 13Y and BD signal 11. Note that as an initial value of the memory 17 which stores the elapsed time T1, a value larger than the reception interval of the transfer belt reference signals 10 is pre-stored, and it is updated to the elapsed time T1 at the time of reception of the initial completion signal 5.

When the scanner phase correction completion time T5 stored in the memory 17 elapses after reception of the initial completion signal 5, the scanner control unit 30 issues an output start instruction of Y image data to the image controller 40 at a timing T103 (first control step). Upon reception of the output start instruction of the Y image data, the image controller 40 transmits raster image data to the laser driving unit 27 in synchronism with the BD signal which has undergone the scanner phase correction.

After that, when the transfer belt reference signal 10 used as an M image write start reference is received at a timing T104, the timer 1 clears the time timed so far, and restarts timing. At the same time, the correction BD output block 7 clears the M correction BD signal 13M, and outputs a correction BD signal having a predetermined period with reference to reception of the transfer belt reference signal 10. Then, when the timer 1 times the time T1, the scanner phase control block 3 starts the scanner phase correction based on the M correction BD signal 13M and BD signal 11. More particularly, in the scanner phase correction, the scanner phase control block 3 corrects to match the rotational phase of the scanner with the output timing of the correction BD signal.

After an elapse of the scanner phase correction completion time T5, the scanner control unit 30 then issues an output start instruction of M image data to the image controller 40 at a timing T105 in synchronism with the BD signal 11 (second control step). That is, the M image data is output after an elapse of T1+T5 since reception of the transfer belt reference signal 10. Note that an output start instruction may be issued to have another time margin ($\alpha$) after an elapse of the waiting time (T1+T5). In this case, the waiting time is (T1+T5+$\alpha$), and the same control processes as those for M are executed for the output control of the C and K correction BD signals, the scanner phase correction start control, and the image data output start control. In this way, various times pursuant to (T1+T5) can be applied as a time required until image formation is ready to start.

<Relationship Between Initial Completion Signal 5 and Reference Signal 10>

The relationship between the initial completion signal 5 and transfer belt reference signal 10 will be described in detail below. The timing of the initial completion signal 5 has an asynchronous relationship with that of the transfer belt reference signal 10. That is, the two signals are received at different timings. Furthermore, the timing of the initial completion signal 5 varies for respective print requests since it is influenced by variations of completion times of activation processes of respective driving units and the processing time of the initial processes of the image controller 40. As a result, a time difference between the timings T101 and T102 (that is, the time T1) often largely changes. When a total time of the times T1 and T5, and a time required until an electrostatic latent image for one page is formed on the photosensitive drum 111 exceeds a time required for one revolution of the transfer belt 110, the transfer belt reference signal 10 of the next color (magenta in this case) is received at the timing T104. At the timing T104, formation of an electrostatic latent image of the previous color (yellow in this case) on the photosensitive drum 111 is in progress. Hence, in this embodiment, the scanner phase correction of the next color is prevented from being executed during formation of an electrostatic latent image on the photosensitive drum 111 by storing the time T1 and executing the scanner phase correction after an elapse of the time T1 since reception of the transfer belt reference signal 10.

<Scanner Control Flowchart>

The scanner control processing sequence according to this embodiment will be described below with reference to FIGS. 6A and 6B. In this case, the scanner control executed from reception of a print start request until completion of image output processes of respective colors will be explained. Note that the processes to be described below are controlled by the engine controller 41.

In step S200, the engine controller 41 receives the print request 3 via the image controller 40. In step S201, the printer control unit 42 of the engine controller 41 starts the initial processes required for image formation. The engine controller 41 determines in step S202 whether or not the transfer belt reference signal 10 is received. The transfer belt reference signal 10 is output when the transfer belt 110 reaches a steady speed according to print control. If the transfer belt reference signal 10 is received, the correction BD output block 7 of the scanner control unit 30 outputs a first correction BD signal (that is, the correction BD signal 13Y for the first color) in step S203. Furthermore, the timer 1 starts timing in step S204. Note that the output process of the correction BD signal may be started by shifting the phase of the correction BD signals 13 from, for example, the timings T101 and T104 if the respective colors have the same conditions.

The printer control unit 42 determines in step S205 whether or not the initial processes as the aforementioned preparation operations are complete. If it is determined that the initial processes are complete, the printer control unit 42 notifies the scanner control unit 30 of the initial completion signal 5, and the process advances to step S206. In step S206, the timer 1 stores the elapsed time T1 timed since reception of the transfer belt reference signal 10 in the memory 17. Furthermore, at the same time with step S206, the selector 56 transmits the phase control start instruction signal 8 to the scanner phase control block 3 in step S207. Note that the transfer belt reference signals 10 are received a plurality of number of times in practice until the transfer belt 110 is stably driven, and the initial completion signal 5 is received after that. In this case, the transfer belt reference signal 10 received immediately before reception of the initial completion signal 5 is adopted. Assume that a new correction BD signal is output every time the transfer belt reference signal 10 is received.

The scanner control unit 30 then determines in step S208 using the timer 1 and memory 17 whether or not the time T5 which is stored in advance and is required until the scanner phase correction is complete elapses. Note that before an elapse of the time T5, the scanner phase control block 3 corrects the rotational phase of the scanner motor, so that the reception timing of the BD signal 11 transmitted from the laser scanner unit 100 matches that of the correction BD signal 13Y. If it is determined in step S208 that the time T5 has elapsed, the process advances to step S5209, and the comparator 9*b* transmits the image output enable signal 15 to the image controller 40.

The engine controller 41 determines in step S210 whether or not the image formations of all the colors have been started. If the image formations of all the colors have been started, the processing ends. On the other hand, if image formation start instructions of arbitrary colors are incomplete, the reference position of the transfer belt 110 is detected again. After that, processes for the second and subsequent colors are executed in steps S211 to S224.

The engine controller 41 determines in step S211 whether or not the transfer belt reference signal 10 is received again. If the transfer belt reference signal 10 is received, the process advances to step S212, and the engine controller 41 determines whether or not the received transfer belt reference signal 10 is that for the second color (magenta in this case). If it is determined that the received transfer belt reference signal 10 is that for the second color, processes for magenta in steps S213 to S216 are executed.

In step S213, the correction BD output block 7 starts generation of a second correction BD signal. In step S214, the timer 1 starts timing. After that, the scanner control unit 30 determines in step S215 whether or not the time timed by the timer 1 has reached the elapsed time T1 of the timer stored in step S206. If the time timed by the timer 1 has reached the time T1, the process advances to step S216, and the selector 56 transmits the phase control start instruction signal 8 to the scanner phase control block 3. Then, the process returns to step S208.

On the other hand, if it is determined in step S212 that the received transfer belt reference signal 10 is not that for the second color, the process advances to step S225, and the engine controller 41 determines whether or not the received transfer belt reference signal 10 is that for the third color (cyan in this case). If it is determined that the received transfer belt reference signal 10 is that for the third color, processes for cyan in steps S217 to S220 are executed. On the other hand, if it is determined that the received transfer belt reference signal 10 is not that for the third color, processes for black as the fourth color in steps S221 to S224 are executed. Note that the processes in steps S217 to S220 and those in steps S221 to S224 are the same as those for magenta in steps S213 to S216, and a description thereof will not be repeated.

Figure 6A:
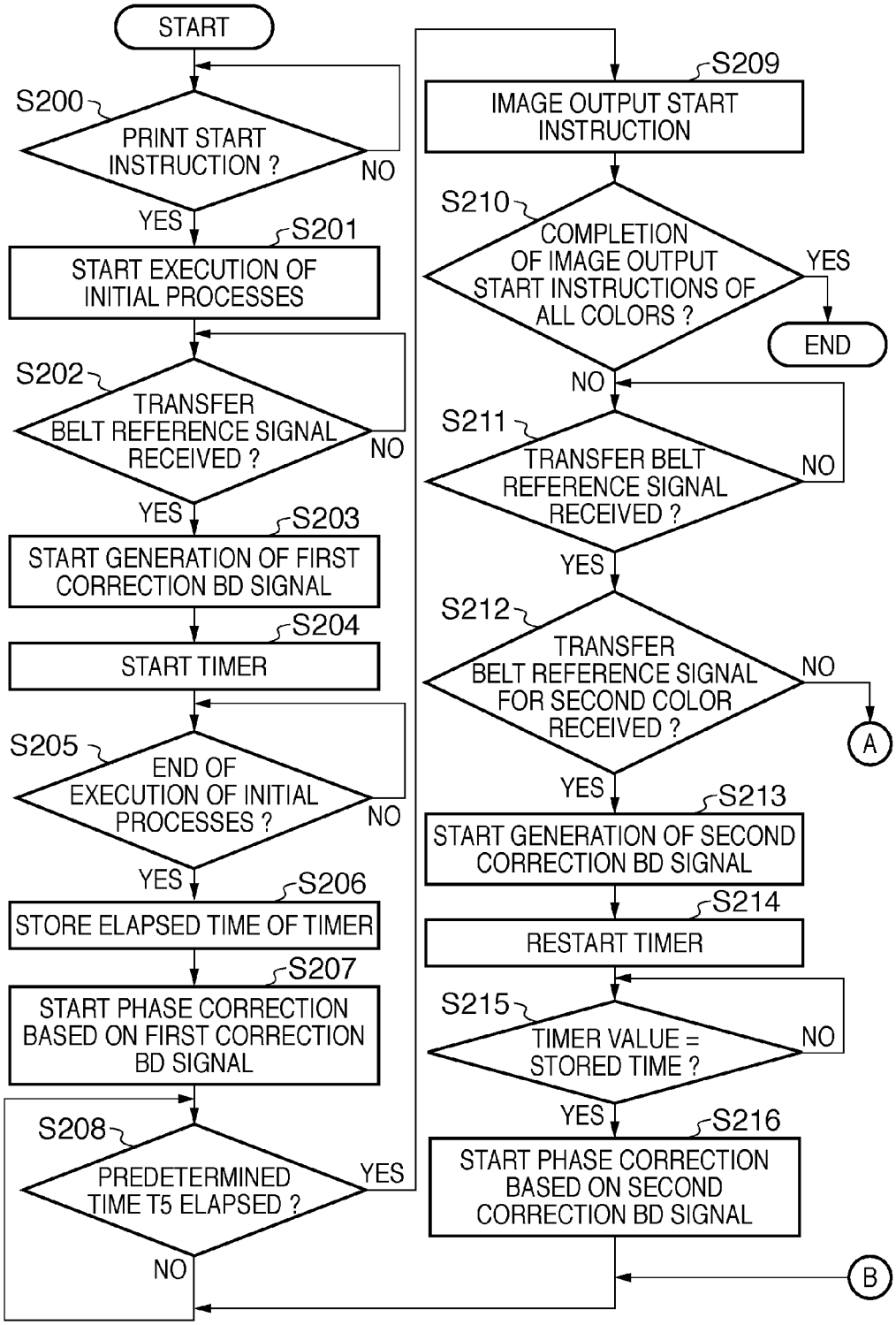
FIGS. 6A and 6B are a flowchart showing the processing sequence of scanner control.
Figure 6B:
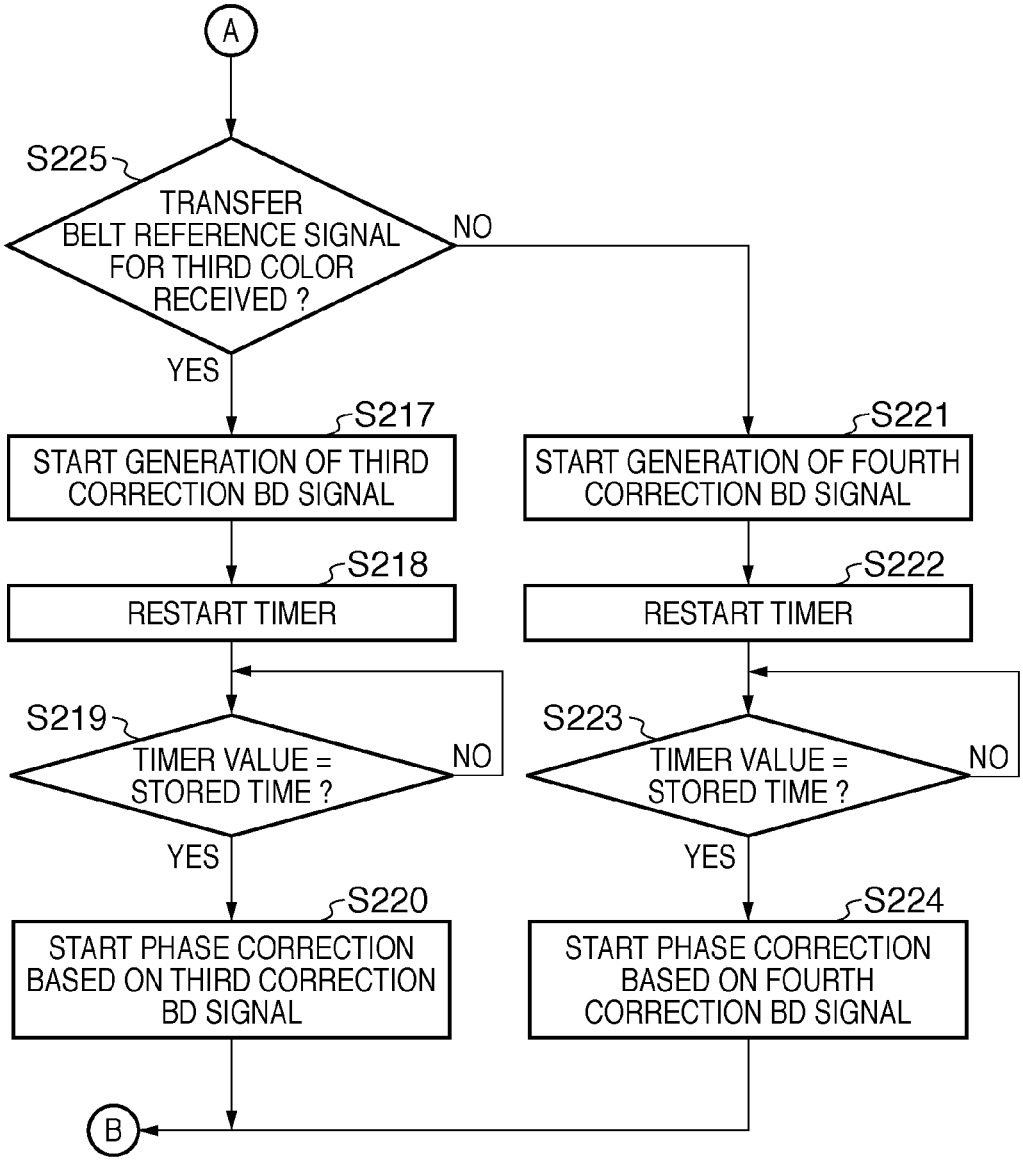

Note that according to the flowchart shown in FIGS. 6A and 6B, the arrangement for outputting the correction BD signals for respective colors is adopted. However, the present invention is not limited to such specific arrangement. For example, an arrangement for outputting two correction BD signals for odd-numbered developing colors (Y and C in this embodiment) and for even-numbered developing colors (M and K in this embodiment) may be adopted, and the correction BD signals may be alternately generated in response to reception of the transfer belt reference signal. More specifically, for example, the arrangement for outputting two correction BD signals (signals 13Y and 13M in FIG. 5) is adopted to output a correction BD signal for C by using the signal 13Y in place of the signal 13C, and a correction BD signal for K by using the signal 13M. This is because image formations of the first color (yellow) and third color (cyan) are not simultaneously executed, and the same applies to the second color (magenta) and fourth color (black). Then, by commonly using the correction BD signal outputs, as described above, the number of circuits which configure the correction BD signal output control can be halved, thus reducing the resource scale of the scanner control unit 30. In this case, the circuits that configure the correction BD signal output control include a timer which measures the period of the correction BD signals, and a correction BD signal output control unit which discriminates the output timing of the correction BD signal based on the timer value, and outputs the correction BD signal.

As described above, the image forming apparatus 1000 according to this embodiment times a time (T1+T5) until image formation is ready to start (the image output enable signal: T103) after the transfer belt reference signal 10 is output (T101). The image forming apparatus 1000 controls to output a light beam (12Y) according to image data in response to that image formation is ready to start. Furthermore, when the next transfer belt reference signal 10 is output during the image formation (T104), the image forming apparatus 1000 outputs the image output enable signal 15 (T105) after a waiting time based on the timed time (T1+T5), and controls to output a light beam according to image data for the next developing color. In this way, this embodiment can improve the image formation throughput in the image forming apparatus 1000 of the rotary method. Furthermore, even when the transfer belt reference signal 10 is received during formation of an electrostatic latent image on the photosensitive drum 111, the image formation start timings of respective colors can be synchronized, thus suppressing generation of image fluctuations and improving the image formation throughput.

Suppression of image fluctuations will be described in some detail below. An electrostatic latent image is formed on a photosensitive member by irradiating the photosensitive member with a light beam according to raster image data with reference to a BD signal, which is output upon detection of a laser beam by the BD sensor 22 arranged on a laser scan line. In this case, since an output interval of the transfer belt reference signals does not always match an integer multiple of a BD period, a time difference between reception of the transfer belt reference signal and that of the BD signal immediately after the transfer belt reference signal varies in the image formation processes of respective developing colors, and a color misalignment for about one line in maximum may occur. Hence, in Japanese Patent Laid-Open No. 09-290534 described above, the image formation processing (for example, laser exposure) is executed by generating a correction BD signal with reference to the reception timing of the transfer belt reference signal, and correcting the rotational phase of the scanner motor so that the output timing of the correction BD signal matches that of the BD signal. Then, this processing is repeated for respective developing colors. In this way, in an image forming apparatus of Japanese Patent Laid-Open No. 09-290534, times required from when the transfer belt reference signals are generated until image data are output can be precisely matched in the image formation processes corresponding to all the developing colors.

However, in the above related art, for example, a time required from reception of the transfer belt reference signal until completion of the preparation operations may be prolonged due to delays caused by temperature adjustment of the fixing device 200 and the rasterization processing of raster image data. In this case, the preparation operations may be completed after completion of the rotational phase correction of the scanner motor. Then, at this time, when latent image formation using a light beam is started from the completion timing of the preparation operations, the transfer belt reference signal for the next color may be received during that formation. Such phenomenon occurs especially in a compact printer. Since the rotational speed of the scanner motor varies by the phase correction control for the next color after the transfer belt reference signal for the next color is received, an electrostatic latent image of the color, which is currently formed (more specifically, a trailing end image of each color), suffers a trouble. For example, color misalignments occur in the sub scanning direction in a generated image.

In order to solve this problem, the phase correction of the scanner motor may be started in response to the transfer belt reference signal received after completion of the preparation operations, and the image formation process may then be executed. However, this control has to wait for completion of the preparation operations, and has to then wait for reception of the transfer belt reference signal, resulting in a low throughput. According to the aforementioned embodiment, when the phase correction of the scanner motor is executed, the image formation throughput can be prevented from being decreased without causing any trouble in an electrostatic latent image.

Second Embodiment

The second embodiment will be described hereinafter with reference to FIGS. 7A to 11. In this embodiment, a correction BD signal is generated at a timing after an elapse of a predetermined time period since detection of a reference position of a transfer belt 110, and phase correction of a scanner is executed simultaneously with that timing. Furthermore, this embodiment includes a detection unit which detects a color misalignment pattern developed on the transfer belt 110, and corrects the generation timing of the correction BD signal based on that detection result. Note that only components and techniques different from the first embodiment will be described below.

<Arrangement of Image Forming Apparatus>

Figure 10:
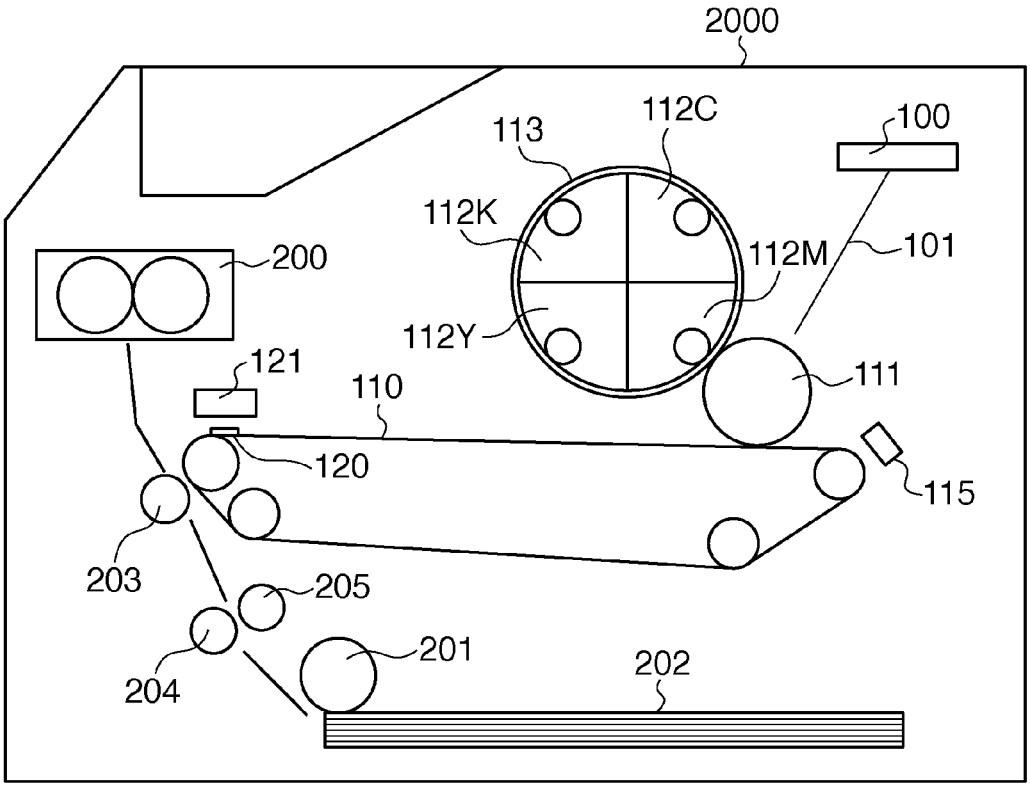
FIG. 10 is a sectional view showing an example of the arrangement of an image forming apparatus 2000.

The arrangement of an image forming apparatus according to this embodiment will be described first with reference to FIG. 10. An image forming apparatus 2000 according to this embodiment includes a color misalignment detection sensor 115 in addition to the arrangement of the image forming apparatus 1000 according to the first embodiment. The color misalignment detection sensor 115 serves as a pattern detection unit, and reads a color misalignment detection pattern developed on the transfer belt 110. Also, in this embodiment, respective loads associated with image formation also serve as a pattern forming unit which forms a color misalignment detection pattern. Since other components are the same as those in the image forming apparatus 1000, a description thereof will not be given.

<Color Misalignment Detection>

Figure 11:
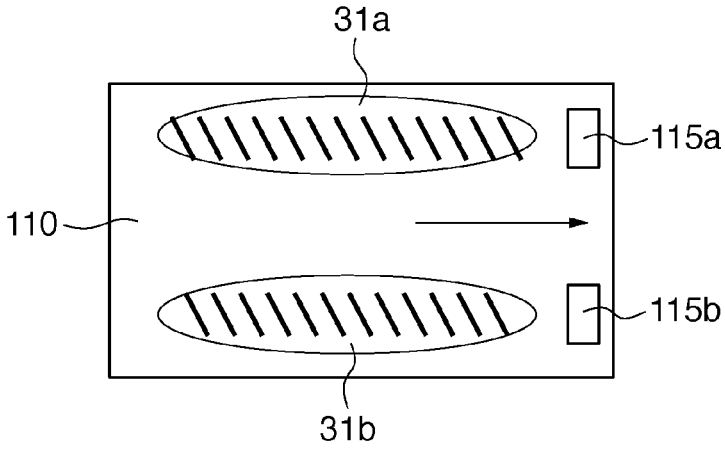
FIG. 11 is a view for explaining a color misalignment detection method.

A color misalignment detection method according to this embodiment will be described below with reference to FIG. 11. FIG. 11 is a plan view of color misalignment detection patterns 31*a* and 31*b* developed on the transfer belt 110, and color misalignment detection sensors 115*a* and 115*b*. At the power-ON timing, at the developer exchange timing, or upon reception of a color misalignment correction request from an image controller 40, the image forming apparatus 2000 develops the color misalignment detection patterns 31*a* and 31*b* shown in FIG. 11 on the transfer belt 110. The color misalignment detection patterns 31*a* and 31*b* include Y, M, C, and K patterns. Then, the color misalignment detection sensors 115*a* and 115*b* detect the color misalignment detection patterns 31*a* and 31*b* developed on the transfer belt 110, and error components (color misalignment amounts) from ideal image formation positions in the sub scanning direction of respective developing colors are calculated from the detection results. Then, a correction time required to correct a waiting time required until scanner phase correction is executed is calculated from the error components, and is stored in an engine controller 41. The engine controller 41 executes the scanner phase correction based on the stored correction time. Detailed control will be described later. Note that the ideal image formation positions in the sub scanning direction correspond to misalignment amounts of measured colors M, C, and K relative to Y if, for example, a reference color is Y. In this case, the correction times are calculated for the respective measured colors, and are stored in the engine controller 41.

<Arrangement of Scanner Control Unit>

Figure 8:
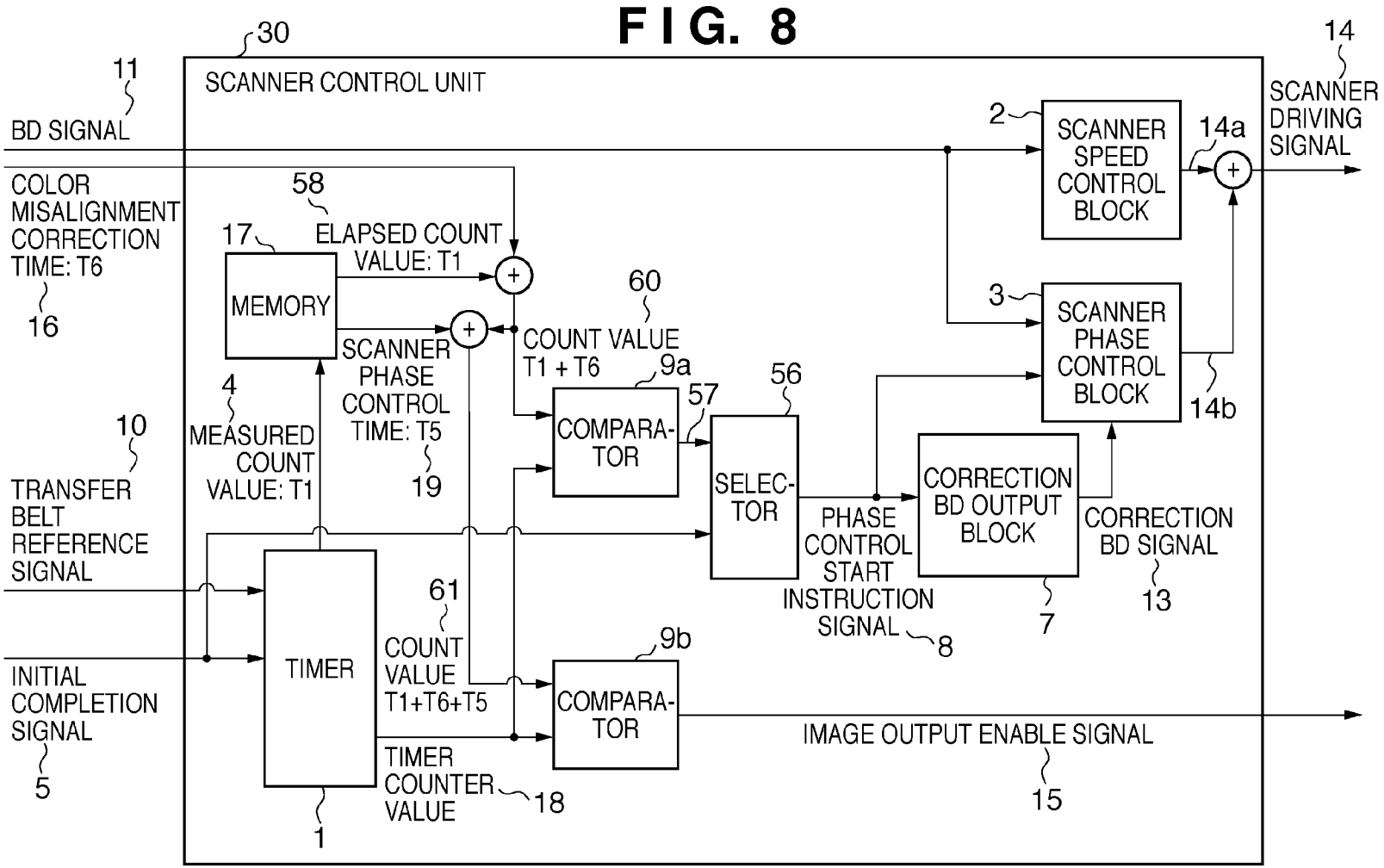
FIG. 8 is a block diagram showing an example of the arrangement of a scanner control unit 30.

The arrangement of a scanner control unit 30 according to this embodiment will be described below with reference to FIG. 8. Note that only components different from those of the scanner control unit 30 according to the first embodiment shown in FIG. 5 will be described below.

According to this embodiment, a comparator 9*a* receives, as a first input, a sum value T1+T6 (count value 60) of count data 58, which is stored in a memory 17 and indicates an elapsed time T1, and count data 16 of a color misalignment correction time T6. In this case, the elapsed time T1 indicates an elapsed time from reception of a transfer belt reference signal 10 until that of an initial completion signal 5. Also, the color misalignment correction time T6 is a value calculated by the color misalignment detection sensor 115. The comparator 9*a* also receives, as a second input, a counter value 18 with reference to the transfer belt reference signal 10 transmitted from a timer 1. Therefore, the comparator 9*a* determines whether or not these two inputs match, and transmits a pulse signal 57 to a selector 56 at a timing when they match.

A comparator 9*b* receives, as a first input, a sum value T1+T5+T6 (count value 61) of the count data 58 of the elapsed time T1, count data 19 of a time T5 required for phase control of a scanner motor, and the count data 16 of the color misalignment correction time T6. Furthermore, the comparator 9*b* receives, as a second input, the counter value 18 with reference to the transfer belt reference signal 10 transmitted from the timer 1. Therefore, the comparator 9*b* determines whether or not these two inputs match, and outputs an image output enable signal 15 as an output start instruction of raster image data to the image controller 40 at a timing when they match.

The selector 56 informs a correction BD output block 7 and scanner phase control block 3 of the initial completion signal 5 at the time of a Y print process and of the pulse signal 57 at the time of M, C, and K print processes, as a correction BD output start & scanner phase control start instruction signal 8. The correction BD output block 7 outputs a correction BD signal 13 with reference to the phase control start instruction signal 8, and informs the scanner phase control block 3 of this signal. Therefore, in this embodiment, the scanner phase control block 3 executes acceleration/deceleration control of the scanner motor from the reception timing of the scanner motor phase control start instruction signal 8, so that a reception time difference between the correction BD signal 13 and BD signal 11 becomes zero (that is, a phase difference becomes zero).

<Scanner Control Timing Chart>

The timings of respective signals upon execution of the laser scanner control according to this embodiment will be described below with reference to FIG. 7A. Upon reception of a print request, the image forming apparatus 2000 starts activations of various actuators and raster image data generation processing first. More specifically, the activations of various actuators are done by, for example, activating a scanner speed control signal 14*a* to "H" and a transfer belt driving signal 32 to "H".

After the speed of the transfer belt 110 stabilizes, when the transfer belt reference signal 10 is received at a timing T101, the timer 1 starts timing with reference to reception of the transfer belt reference signal 10. After that, upon completion of preparation operations required for the start of image formation, a printer control unit 42 transmits the initial completion signal 5 to the scanner control unit 30 at a timing T102.

When the initial completion signal 5 is transmitted to the scanner control unit 30, the scanner control unit 30 stores the elapsed time T1 from the timing T101 until the timing T102 in the memory 17. Note that as an initial value of the memory 17 which stores the elapsed time T1, a value larger than the reception interval of the transfer belt reference signals 10 is pre-stored, and it is updated to the elapsed time T1 at the time of reception of the initial completion signal 5. At the same time, the selector 56 issues a correction BD signal output start instruction to the correction BD output block 7. In response to this instruction, the correction BD output block 7 outputs a correction BD signal 13 for Y. Furthermore, the scanner phase control block 3 starts the scanner phase correction according to the correction BD signal 13 transmitted from the correction BD output block 7.

Figure 7A:
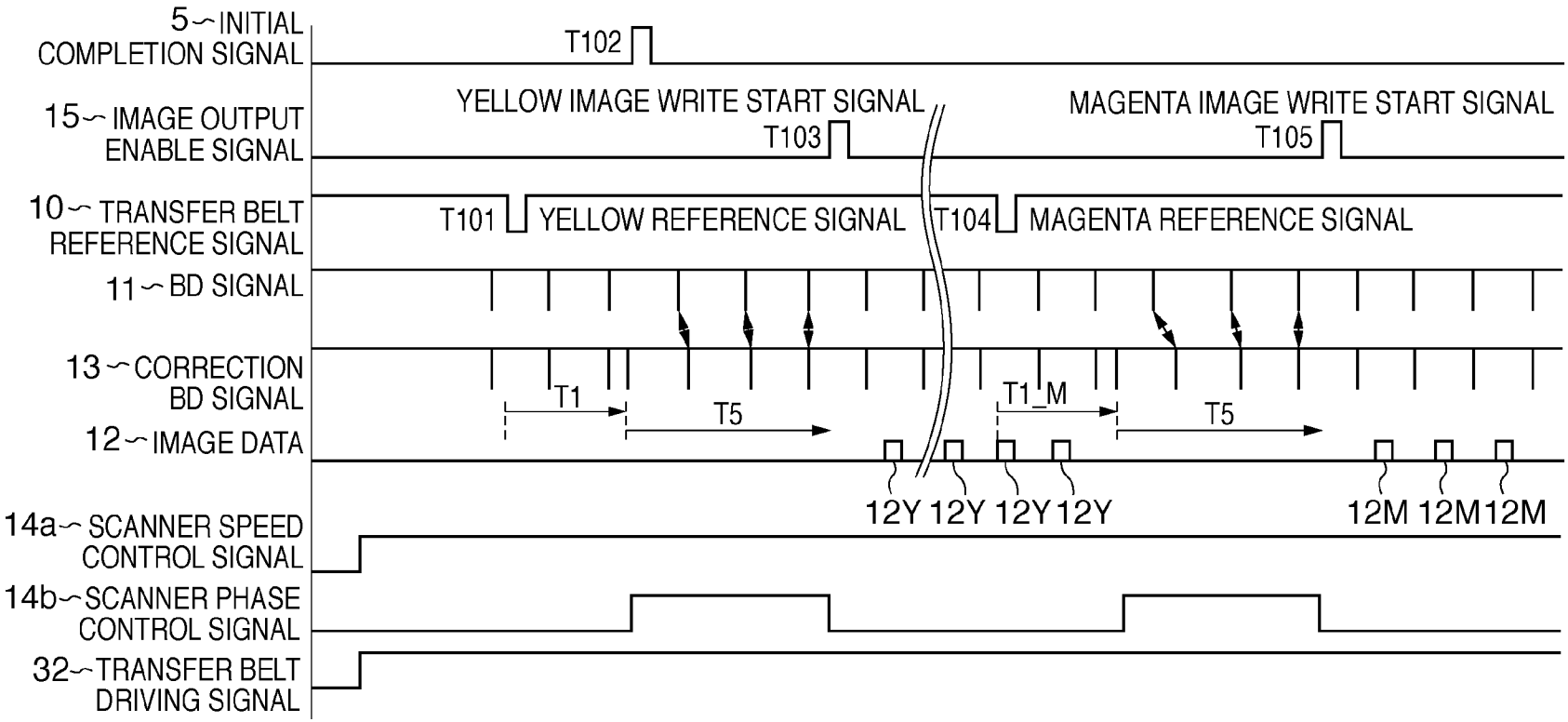
FIG. 7A is a timing chart showing the timings of respective signals in scanner control.

Note that the correction BD signal 13 begins to be output (corresponding to a zero phase) after an elapse of T1 in FIG. 7A. However, for example, the output timing of the correction BD signal 13 may be shifted within a correction BD signal period. In this case, upon outputting the correction BD signals 13 after elapses of times T1_M, T1_C, and T1_K (to be described later), the output timings have to be shifted under the same conditions. That is, as the start timing of the correction BD signal 13, various timings can be provided as long as it is based on a timing after an elapse of T1.

When the scanner phase correction completion time T5 stored in the memory 17 has elapsed, the scanner control unit 30 issues an output start instruction of Y image data to the image controller 40 at a timing T103. Upon reception of the output start instruction of the Y image data, the image controller 40 transmits raster image data to a laser driving unit 27 in synchronism with the BD signal which has undergone the scanner phase correction.

Next, when the transfer belt reference signal 10 used as an M image write start reference is received at a timing T104, the timer 1 clears the time timed so far, and restarts timing. After that, when the counter value 18 of the timer 1 has reached the sum time T1+T6 of the elapsed time T1 and the M color misalignment correction time T6 (at an elapsed timing of T1_M), the correction BD output block 7 outputs an M correction BD signal 13. The scanner phase control block 3 starts the scanner phase correction according to the correction BD signal 13. In this manner, the correction BD signal 13 begins to be output when the time T1 elapses from the timing T101 and when the time T1_M elapses from the timing T104. Therefore, different correction BD signals for respective developing colors need not be output unlike in the first embodiment. That is, the control load can be reduced compared to the first embodiment.

Furthermore, after an elapse of the scanner phase correction completion time T5 stored in the memory 17, the scanner control unit 30 issues an output start instruction of M image data to the image controller 40 at a timing T105. Note that as output control of correction BD signals, scanner phase correction start control, and image data output start control for C and K, the same control processes as those for M are executed.

Figure 7B:
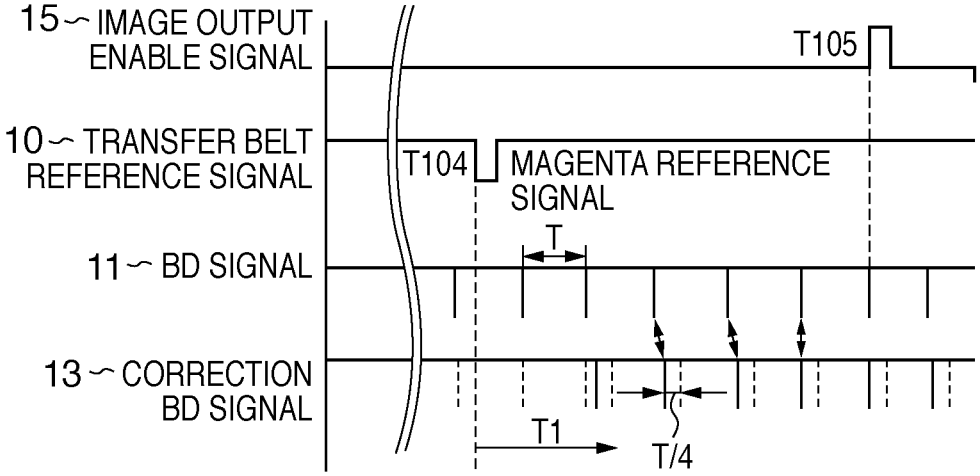
FIG. 7B is a timing chart showing the timings of respective signals in the scanner control.

In this way, when the image forming apparatus is actually used at a user site, color misalignments of measured colors with respect to a reference color (for example, Y) have occurred, and the control waits not for the time T1+T5 until image formation is ready to start but for the time T1+T5 plus T6. Then, more precise electrostatic image formations can be attained. As a modification, in place of waiting for times T1_M, T1_C, and T1_K, the control may wait for T1 in case of all developing colors to control the output start phase of the BD correction signals 13. FIG. 7B shows a practical example. The example of FIG. 7B shows a measure taken when the M write start timing is delayed by a time equivalent to a ¼ line interval from Y as a reference color. That is, letting T be the BD period, the phase of the correction BD signal after an elapse of T1 is advanced by T/4 ahead of that before correction (dotted line).

Figure 9:
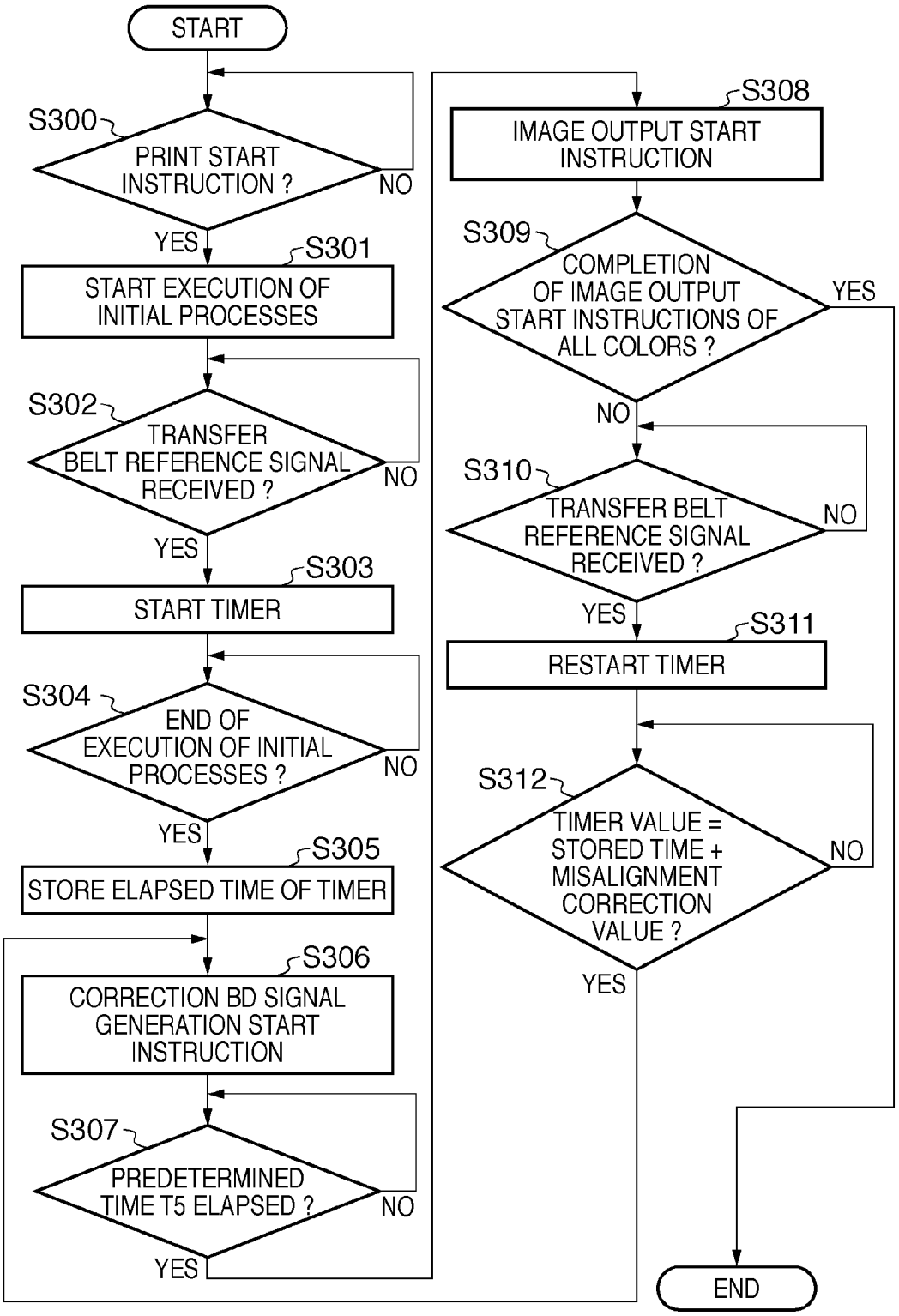
FIG. 9 is a flowchart showing the processing sequence of scanner control.

The scanner control processing sequence according to this embodiment will be described below with reference to FIG. 9. In this case, the scanner control executed from reception of a print start request until completion of image output processes of respective colors will be explained. Note that the processes to be described below are controlled by the engine controller 41.

In step S300, the engine controller 41 receives a print request 3 via the image controller 40. In step S301, the printer control unit 42 of the engine controller 41 starts initial processes required for image formation. The engine controller 41 determines in step S302 whether or not the transfer belt reference signal 10 is received. The transfer belt reference signal 10 is output when the transfer belt 110 reaches a steady speed according to print control. If the transfer belt reference signal 10 is received, the timer 1 starts timing in step S303. After that, the printer control unit 42 determines in step S304 whether or not the initial processes are complete. If the initial processes are complete, the process advances to step S305.

In step S305, the timer 1 stores the elapsed time T1 timed since reception of the transfer belt reference signal 10 in the memory 17. Furthermore, at the same time with step S305, the correction BD output block 7 begins to output the correction BD signal 13 with reference to the phase control start instruction signal 8 transmitted by the selector 56 in step S306. Then, the scanner phase control block 3 starts the rotational phase correction of the scanner motor, so that the reception timing of the BD signal 11 transmitted from a laser scanner unit 100 matches that of the correction BD signal 13.

The scanner control unit 30 then determines in step S307 using the timer 1 and memory 17 whether or not the time T5 which is stored in advance and is required until the scanner phase correction is complete elapses. If the time T5 has elapsed, the process advances to step S308, and the comparator 9*b* transmits the image output enable signal 15 to the image controller 40.

The engine controller 41 determines in step S309 whether or not the image formations of all the colors have been started. If the image formations of all the colors have been started, the processing ends. On the other hand, if image formation start instructions of arbitrary colors are incomplete, the reference position of the transfer belt 110 is detected again. After that, processes in steps S310 to S312 are executed.

The engine controller 41 determines in step S310 whether or not the transfer belt reference signal 10 is received. If the transfer belt reference signal 10 is received, the process advances to step S311. In step S311, the timer 1 clears the time timed so far, and restarts timing. After that, the scanner control unit 30 determines in step S312 whether or not the counter value 18 of the timer 1 reaches a sum time of the elapsed time T1 and the color misalignment correction time T6. If the counter value 18 has reached the sum time, the process returns to step S306 to start processes for the next color. In this way, the correction BD output block 7 outputs a correction BD signal for the next color. After that, as in the Y control, after an elapse of the predetermined time T5, the image output enable signal 15 is transmitted to the image controller 40, thus executing image processing.

As described above, the image forming apparatus 2000 according to this embodiment forms the color misalignment detection patterns on the transfer belt 110, detects the formed color misalignment detection patterns, and reflects the detection result to the waiting time T1 of the corresponding color. In this manner, based on T1 timed in FIG. 7A and the color misalignment amount of each measured color from the reference color, a semiconductor laser 29 emits a light beam according to image data of that measured color. Therefore, an image in which color misalignments in the sub scanning direction are more eliminated can be formed.

The description related to color misalignments has been given above. This technique is also applicable to the first embodiment. For example, a color misalignment amount of the corresponding color may be reflected to the elapsed time T1 counted in each of steps S215, S219, and S223 in the flowchart shown in FIGS. 6A and 6B. Alternatively, when the time duration of T5 has a slight margin with respect to a time required for the scanner motor phase control, a color misalignment amount of the current color of interest (measured color) may be reflected in step S208.

Third Embodiment

Figure 12:
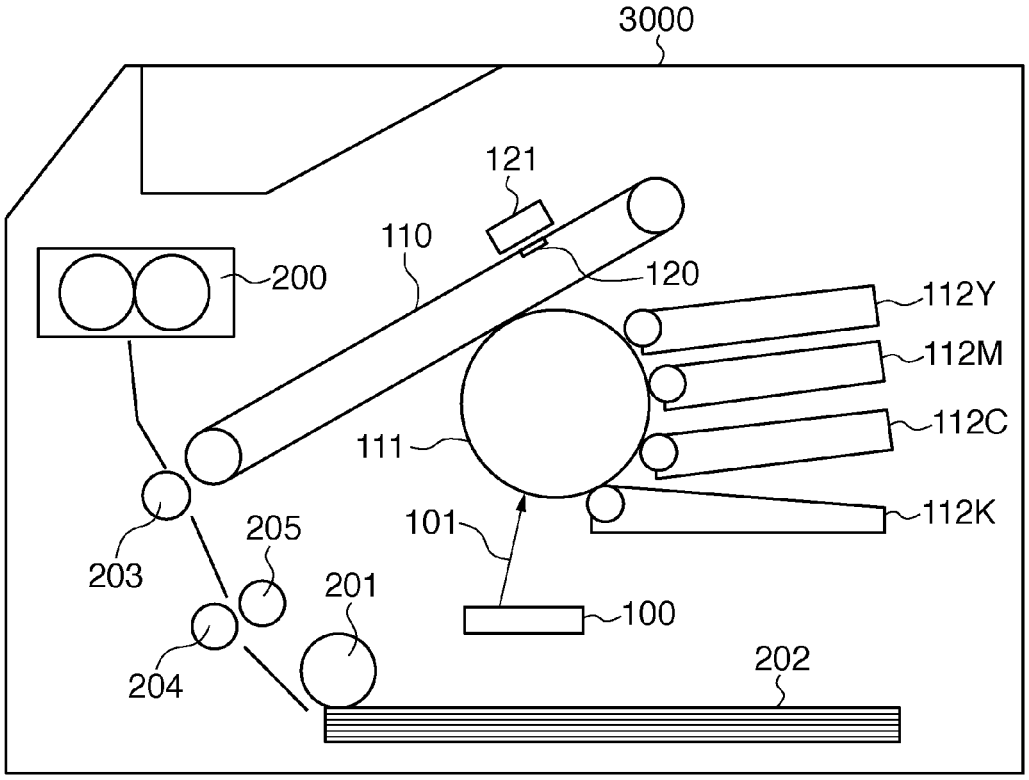
FIG. 12 is a sectional view showing an example of the arrangement of an image forming apparatus 3000.

The third embodiment will be described hereinafter with reference to FIG. 12. This embodiment is different from the above embodiments in that each of a plurality of developers has a unique contact/withdrawal position with respect to a single photosensitive drum. Note that the arrangement of a laser scanner unit and a scanner control method according to this embodiment are the same as those in the above embodiments, and a description thereof will not be given.

Reference numerals 112Y, 112M, 112C, and 112K denote developers which store toners. As shown in FIG. 12, these developers 112Y, 112M, 112C, and 112K respectively have unique contact/withdrawal positions with respect to a photosensitive drum 111. That is, the respective developers 112 are independently arranged along the vicinity of the photosensitive drum 111. Since other components are the same as those in the above embodiments, a repetitive description thereof will be avoided. In an image forming apparatus 3000 of this embodiment as well, a time from reception of a transfer belt reference signal 10 of each color until an initial completion signal 5 is timed, and a scanner phase correction execution timing is controlled according to the timing result. Thus, the image forming apparatus 3000 according to this embodiment can execute the scanner phase control without generating any image fluctuations, and can eliminate color misalignments in the sub scanning direction associated with a print image.

In the above descriptions related to FIG. 1 and FIGS. 7A and 7B, the scanner rotational phase correction based on a correction BD signal has been exemplified. However, the present invention is not limited to such embodiment. For example, in a modification, the scanner rotational phase correction may be omitted from FIG. 1 and FIGS. 7A and 7B. In this case, an output start instruction of image data is issued by waiting for a time T1 from when a transfer belt reference signal 10 is detected until predetermined preparation operations are complete (an image write start signal is output) in FIG. 1 and FIGS. 7A and 7B. With this arrangement, although color misalignments equivalent to one main scanning line interval in maximum may be generated, an image formation throughput in an image forming apparatus of, for example, a rotary method can be improved as in the first and second embodiments.

Note that when the scanner rotational phase correction is omitted in FIGS. 7A and 7B, the time T1 is measured in the same manner as in FIGS. 7A and 7B. Then, when the transfer belt reference signal 10 corresponding to each measured color is output, the controls waits for the time T1 timed in advance and a time (T1_M, T1_C, or T1_K) based on a detected color misalignment amount, and light irradiation is executed according to image data.

The aforementioned modification in which the scanner rotational phase correction is omitted is not limited to the image forming apparatus using a semiconductor laser 29 and polygon mirror (rotating polygonal mirror) 20. For example, an image forming apparatus may include a light emitting array on which a plurality of light emitting elements (LEDs) are arranged along the rotational axis direction of the photosensitive drum 111, and may form an electrostatic latent image on the photosensitive drum 111 by light emitted by the light emitting array. In this case as well, as in the first and second embodiments, an image formation throughput of an image forming apparatus of, for example, a rotary method can be improved. Also, in place of the aforementioned light emitting array, an image forming apparatus may include a plurality of electrode arrays which are arranged along the rotational axis direction of the photosensitive drum 111 at a position, which opposes each developer 112 used to perform toner development, on the back surface of a toner image carrier surface of the photosensitive drum 111, and may perform formation of an electrostatic latent image and its toner development on the photosensitive drum 111 by a static electric field generated by a voltage applied to the electrode arrays. In this case as well, as in the first and second embodiments, an image formation throughput of an image forming apparatus of, for example, a rotary method can be improved. Also, the same modifications apply to embodiments to be described hereinafter.

Fourth Embodiment

The fourth embodiment will be described hereinafter. This embodiment will explain a case in which an image of the second page is formed when a time shorter than that required for one revolution of a transfer belt 110 elapses, so as to improve the image formation productivity. In this embodiment, portions different from the aforementioned embodiments will be mainly explained.

<Arrangement of Printer Control Unit 42>

Figure 13:
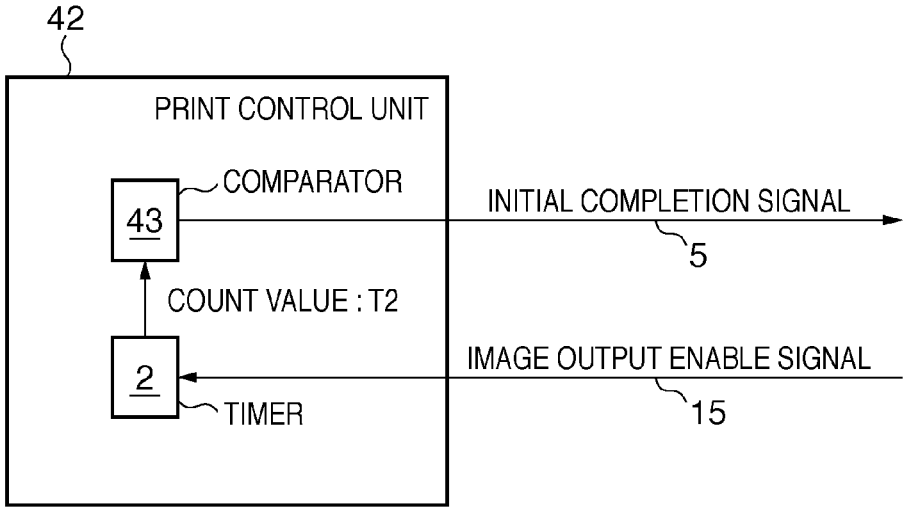
FIG. 13 is a block diagram showing an example of the arrangement of a printer control unit 42.

The arrangement of a printer control unit 42 according to this embodiment will be described below with reference to FIG. 13. In this case, only components different from those in the printer control unit 42 according to the first embodiment will be explained.

In this embodiment, the printer control unit 42 includes a timer 2 and comparator 43. The timer 2 receives an image formation output enable signal 15 from a scanner control unit 30. Then, the timer 2 resets an elapsed time to zero and starts timing at the same time. The timer 2 inputs a count time T2 to the comparator 43.

When the input image formation output enable signal 15 indicates the fourth color, the comparator 43 notifies the scanner control unit 30 of an initial completion signal 5 at a timing at which a time (count value) of the count time T2 input from the timer 2 indicates an elapse of a predetermined time. In this case, the predetermined time indicates a time obtained by adding a rotation time required to the next developing color to a time obtained by dividing a paper size by a process time and a time required for latent image formation, and subtracting a phase control time T5 from the sum. Note that as an initial count value of the timer 2, a value larger than a reception interval of transfer belt reference signals 10 is pre-stored.

<Scanner Control>

Figure 14A:
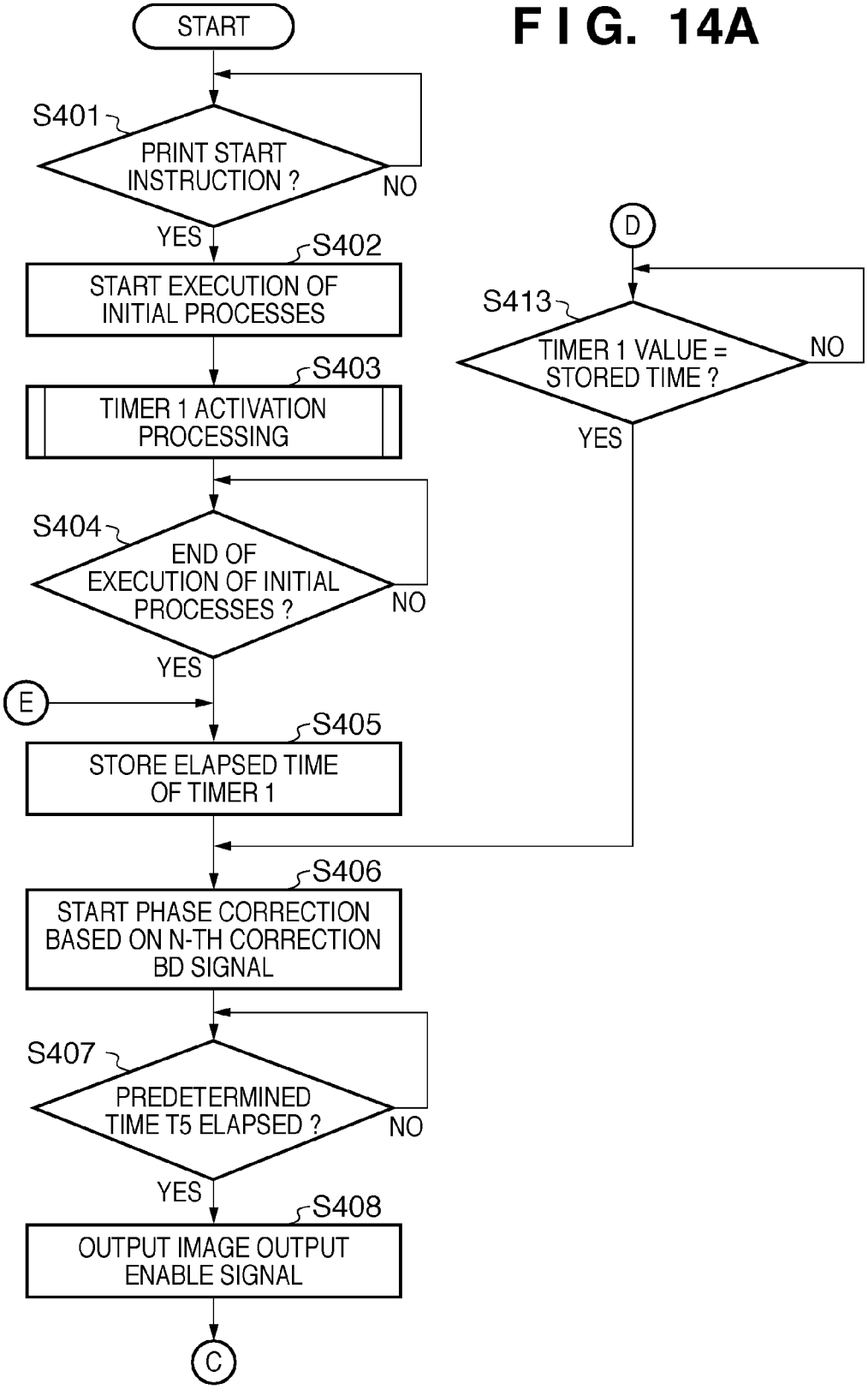
FIGS. 14A to 14C is a flowchart showing the processing sequence of scanner control.
Figure 14B:
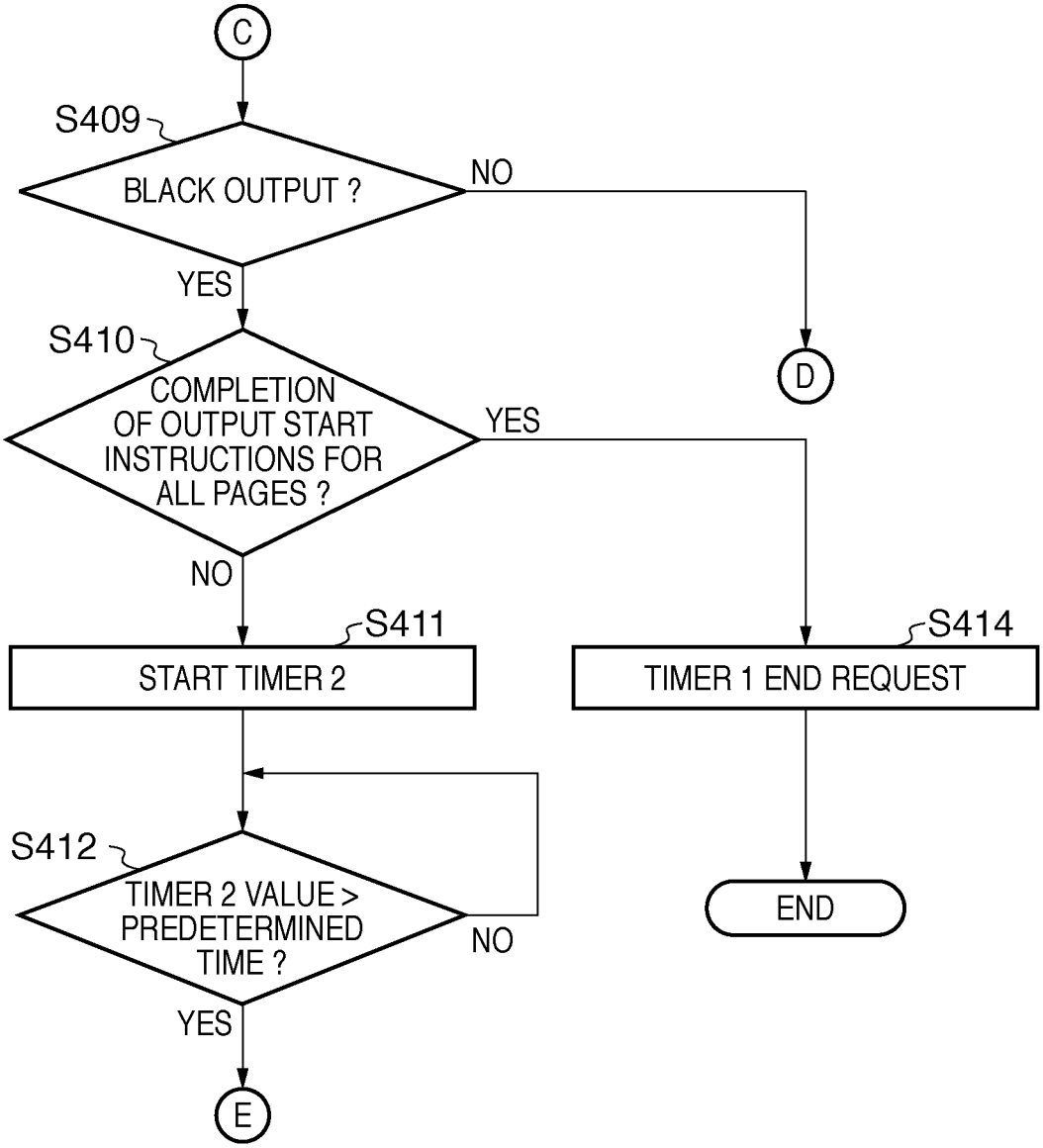
Figure 14C:
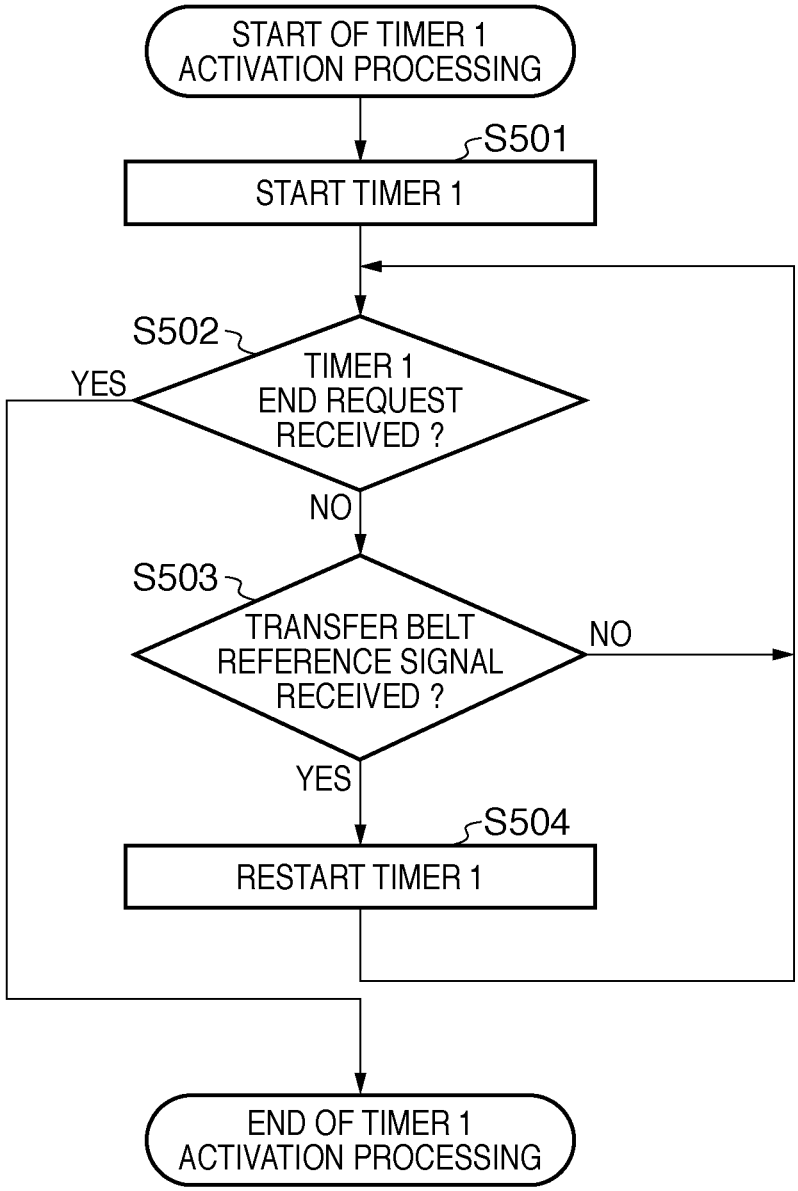

The scanner control processing sequence according to this embodiment will be described below with reference to FIGS. 14A to 14C. Note that the processes to be described below are controlled by an engine controller 41.

In step S401, the engine controller 41 receives a print request 3 via an image controller 40. In step S402, the printer control unit 42 of the engine controller 41 starts initial processes required for image formation. In step S403, the engine controller 41 executes timer 1 activation processing. Note that the timer 1 activation processing is a program different from a main processing program, and the engine controller 41 executes main processing and activation processing as simultaneous parallel processes by alternatively processing the main processing program and the timer 1 activation processing program. Alternatively, step S503 in the timer 1 activation processing program may be executed as interrupt processing which is executed at the time of reception of the transfer belt reference signal 10.

After the timer 1 activation processing is executed, the engine controller 41 starts a timer 1 in step S501. The engine controller 41 confirms a timer 1 end request in step S502. If the end request is received, the engine controller 41 ends the timer 1 activation processing. The engine controller 41 determines in step S503 whether or not the transfer belt reference signal 10 is received. The transfer belt reference signal 10 is output when a transfer belt 110 reaches a steady speed according to print control. If the transfer belt reference signal 10 is received, the timer 1 is reset and starts timing in step S504. After that, the printer control unit 42 determines in step S404 whether or not the initial processes are complete. If the initial processes are complete, the process advances to step S405.

In step S405, the printer control unit 42 stores an elapsed time T1 timed by the timer 1 since reception of the transfer belt reference signal 10 in a memory 17, and corrects a waiting time after reception of the transfer belt reference signal. In step S406, the printer control unit 42 notifies the scanner control unit 30 of the initial completion signal 5, and a selector 56 transmits a phase control start instruction signal 8 to a scanner phase control block 3.

Next, the scanner control unit 30 determines in step S407 using the timer 1 and memory 17 whether or not a time T5, which is stored in advance and is required until scanner phase correction is complete, elapses. Note that before an elapse of the time T5, the scanner phase control block 3 corrects the rotational phase of a scanner motor, so that the reception timing of a BD signal 11 transmitted from a laser scanner unit 100 matches that of a correction BD signal 13Y. If it is determined in step S407 that the time T5 has elapsed, the process advances to step S408, and a comparator 9*b* transmits the image output enable signal 15 for the first color to the image controller 40.

The engine controller 41 determines in step S409 whether or not the immediately preceding image output enable signal is transmitted for black, that is, the fourth color (last color). If the black image output enable signal is transmitted, the process advances to step S410. On the other hand, if image output enable signals for all the colors are not yet transmitted, the process advances to step S413.

The printer control unit 42 determines in step S413 whether or not the count value of the timer 1 matches the time stored in step S405, so as to take synchronization with the transmission timing of the image output enable signal for the second or subsequent color. If the count value matches the stored time, the printer control unit 42 notifies the scanner control unit 30 of the initial completion signal 5, and the selector 56 transmits the phase control start instruction signal 8 to the scanner phase control block 3 in step S406. Since the processing for transmitting the image output enable signals 15 for the third and fourth colors to the image controller 40 is the same as that for the second color, a description thereof will not be repeated.

The engine controller 41 determines in step S410 whether or not the image formations for all pages have been started. If the image output enable signals 15 for all the pages have been transmitted to the image controller 40, the process advances to step S411. On the other hand, if the image output enable signals for all the pages have not been transmitted yet, the process advances to step S414.

In step S411, the engine controller 41 starts the timer 2. The engine controller 41 then determines in step S412 whether or not the value of the timer 2 reaches a predetermined value (T2) that allows the next image formation. Assume that this predetermined value is pre-stored in the memory 17 in a format that the engine controller 41 (printer control unit 42) can refer to.

In this case, the predetermined value corresponds to each paper size (B5 size, A4 size, legal size, etc.). For example, the length of the transfer belt 110 in a rotation direction (that in a moving direction) is designed to have the length of the legal size in the longitudinal direction as a maximum size. In case of this example, T2 that assumes a value smaller than T2 corresponding to the legal size is set for, for example, the A4 size. Then, the value T2 is set to assure a maximum time required for executing light emitting control (laser scan control) of a semiconductor laser 29 for one page according to black image data, and a movement to a primary transfer position of a developer 112Y of the next color after an elapse of a time T2+T5. Therefore, when a rotary developer holding unit 113 has a higher rotational moving speed, T2 can be set to be a smaller value. Also, for example, when scanner motor phase control is omitted, a smaller value can also be set. Note that when the aforementioned conditions are satisfied before one revolution of the transfer belt 110 in case of image formation of the legal size, and the next Yellow image write start signal can be output, the value T2 in case of the legal size may be adopted for all the paper sizes, thus obtaining a given effect.

If the engine controller 41 determines in step S412 that the timer 2 has exceeded the predetermined time value, the process advances to step S405. In step S405, the printer control unit 42 stores an elapsed time timed by the timer 1 since reception of the transfer belt reference signal 10 in the memory 17 again. In step S406, the printer control unit 42 notifies the scanner control unit 30 of the initial completion signal 5, and the selector 56 transmits the phase control start instruction signal 8 to the scanner phase control block 3.

When the process advances from step S412 to step S405, the following processing is allowed. That is, as for an image formation of yellow (first color) of a page next to a page which undergoes the image formation of the last color (black), the image formation of the first color of the next page can be executed from when the image formation of the last color of that page is started before the transfer belt 110 as a rotation member makes one revolution.

<Scanner Control Timing Chart>

Figure 15:
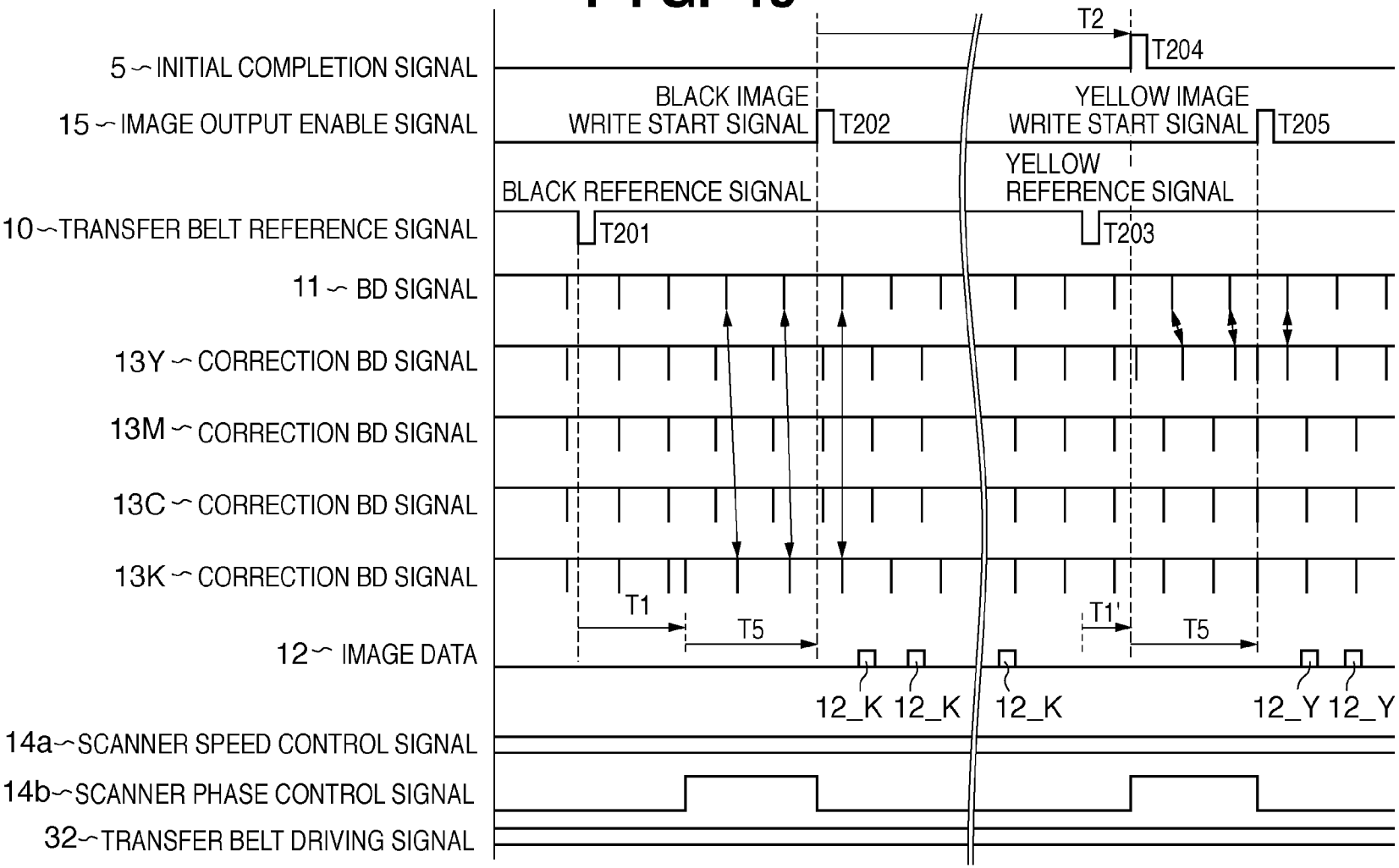
FIG. 15 is a timing chart showing the timings of respective signals in scanner control.

The timings of respective signals upon execution of the laser scanner control of this embodiment will be described below with reference to FIGS. 14 and 15. Note that as a detailed situation, a description of image formation control until the third color (cyan) will not be given, and situations of the last color (black) as the fourth color and the first color (yellow) for the next print sheet will be explained.

When the transfer belt reference signal 10 used as a black image write start reference is received at a timing T201, the timer 1 clears the time timed so far, and restarts timing (steps S503 and S504).

At the same time, a correction BD output block 7 clears a correction BD signal 13K for black, and outputs a correction BD signal with reference to reception of the transfer belt reference signal 10. If the timed time of the timer 1 matches the time T1 (YES in step S413), the scanner phase control block 3 starts scanner phase correction based on the correction BD signal 13K for black and a BD signal 11 (step S406).

After that, when a scanner phase correction completion time T5 has elapsed, the scanner control unit 30 issues an output start instruction of black (last color) image data to the image controller 40 at a timing T202 (step S408). At the same time, the engine controller 41 notifies the printer control unit 42 of the start of black image formation, and also controls the timer 2 to start timing (step S411).

When the transfer belt reference signal 10 used as a yellow image write start reference for the next print sheet is received at a timing T203, the timer 1 clears the time timed so far, and restarts timing.

At a timing T204 after the timed time T2 of the timer 2 has elapsed, the printer control unit 42 transmits the initial completion signal 5 to the scanner control unit 30 (step S412).

When the initial completion signal 5 is transmitted to the scanner control unit 30, the scanner control unit 30 stores an elapsed time from the timing T203 until the timing T204 in the memory 17 as T1' (step S405). At the same time, the scanner control unit 30 transmits the phase control start instruction signal 8 to the scanner phase control block 3 (step S406). Then, the scanner phase control block 3 starts scanner phase correction based on the correction BD signal 13Y for Y and BD signal 11.

When the scanner phase correction completion time T5 has elapsed (YES in step S407), the scanner control unit 30 issues an output start instruction of yellow (first color of the next page) image data to the image controller 40 at a timing T205. The same control processes as those for yellow are executed as output control of correction BD signals, scanner phase correction start control, and image data output start control for the subsequent colors, that is, magenta, cyan, and black.

The relationship between the initial completion signal 5 and transfer belt reference signal 10 will be described in detail below. The timing of the initial completion signal 5 after the start of print processing has an asynchronous relationship with that of the transfer belt reference signal 10. Furthermore, since the timing of the next initial completion signal 5 is influenced by an image formation time, the scanner phase correction start timing having the transfer belt reference signal 10 as a start point is not always constant. As a result, the time T1 stored so far is different from the time T1' between the timings T203 and T204. Furthermore, when T1' is shorter than T1, the image formation can be continued without being synchronized with one revolution of the transfer belt 110. Hence, sheet intervals can be reduced, and the productivity of the image forming apparatus can be consequently improved.

<Another Scanner Control Timing Chart>

Figure 16:
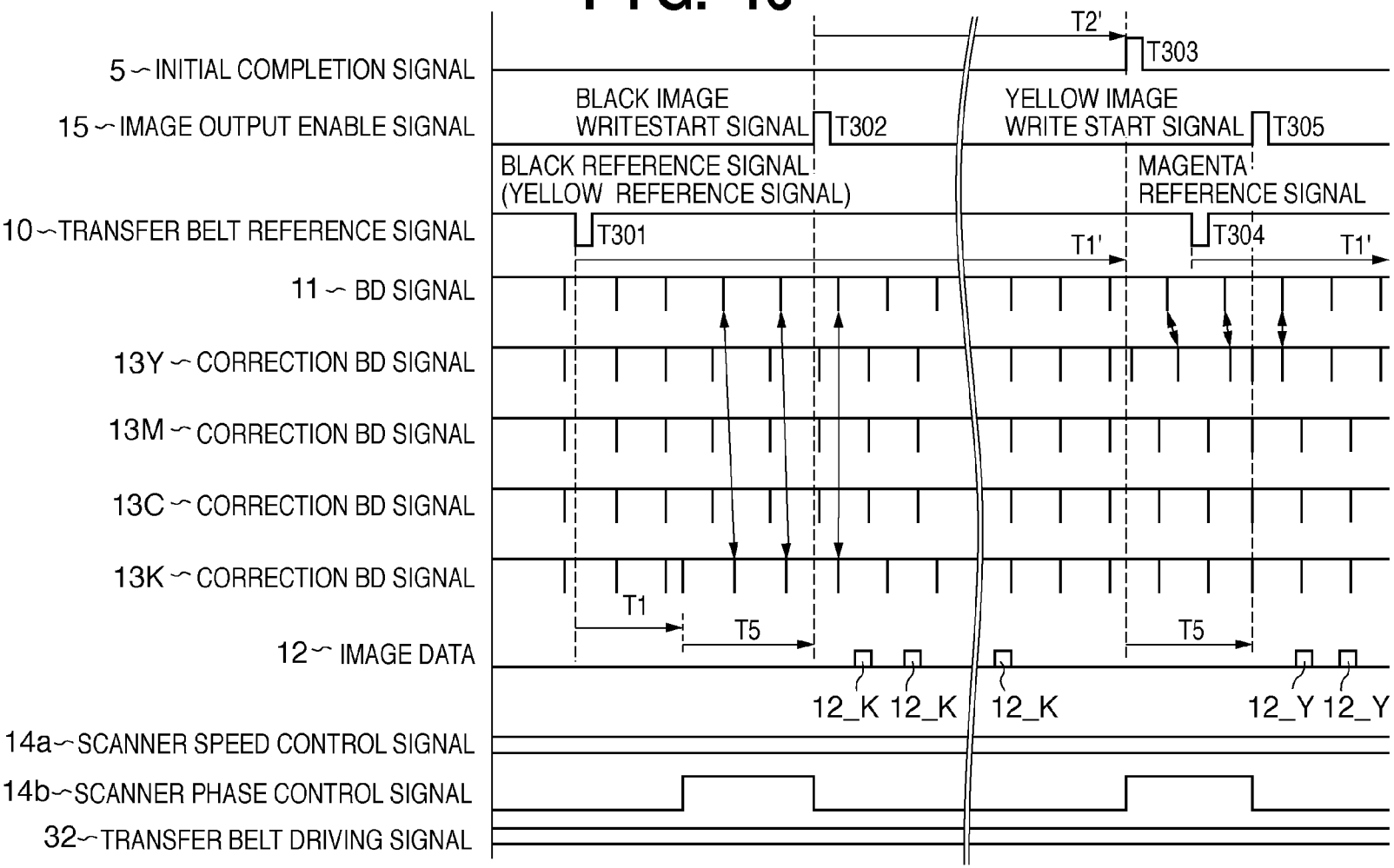
FIG. 16 is a timing chart showing the timings of respective signals in scanner control.

The timings of respective signals upon execution of the laser scanner control according to the fourth embodiment will be described below with reference to FIGS. 14 and 16. Note that as a detailed situation of FIG. 16, a case will be explained below wherein an identical transfer belt reference signal is used as a start point for the fourth color (black) and the first color (yellow) of the next print sheet.

When the transfer belt reference signal 10 used as a black image write start reference is received at a timing T301, the timer 1 clears the time timed so far, and restarts timing (steps S503 and S504).

At the same time, the correction BD output block 7 clears the correction BD signal 13K for black, and outputs a correction BD signal with reference to reception of the transfer belt reference signal 10. If the timed time of the timer 1 matches the time T1 (YES in step S413), the scanner phase control block 3 starts scanner phase correction based on the correction BD signal 13K for black and BD signal 11 (step S406).

When the scanner phase correction completion time T5 has elapsed, the scanner control unit 30 issues an output start instruction of black image data to the image controller 40 at a timing T302 (step S408). At the same time, the engine controller 41 notifies the printer control unit 42 of the start of black image formation, and starts timing of the timer 2 (step S411).

At a timing after a timed time T2' of the timer 2 has elapsed, that is, at a timing T303 before the transfer belt reference signal 10, the printer control unit 42 transmits the initial completion signal 5 to the scanner control unit 30 (step S412).

When the initial completion signal 5 is transmitted to the scanner control unit 30, the scanner control unit 30 stores an elapsed time from the timing T302 until the timing T303 in the memory 17 as T1' (step S405). At the same time, the scanner control unit 30 transmits the phase control start instruction signal 8 to the scanner phase control block 3 (step S406). FIG. 16 corresponds to the case in which the timer value T2 has reached the predetermined value before the transfer belt 110 makes one revolution (an elapse of time from detection of a Black reference signal in the timing T301 until detection of a next Yellow reference signal). In this case, since YES is not determined in step S503 of the timer activation processing in FIGS. 14A to 14C, and the timer 1 is not restarted, the value T1' becomes larger than that in FIG. 15. Also, as for the stored elapsed time T1' of the timer 1, which is stored in this case, since no new transfer belt reference signal 10 is received, the black reference signal (T301) matches the yellow reference signal. The above determination is performed by the engine controller 41.

After that, when the transfer belt reference signal 10 used as an image write start reference is received at a timing T304, the engine controller 41 handles that signal as a magenta reference signal, clears the time timed so far, and restarts timing (steps S502 to S504). When the scanner phase correction completion time T5 has elapsed (YES in step S407), the scanner control unit 30 issues an output start instruction of yellow image data to the image controller 40 at a timing T305.

The same control processes as those for yellow are executed as output control of correction BD signals, scanner phase correction start control, and image data output start control for the subsequent colors, that is, magenta, cyan, and black. A magenta image write start signal output timing assured after the timing T304, which is not shown in FIG. 16, will be described below. When the timed time of the timer 1 matches the time T1' (YES in step S413), the scanner phase control block 3 starts scanner phase correction based on a correction BD signal 13M for magenta and BD signal 11 (step S406). When the scanner phase correction completion time T5 has elapsed, the scanner control unit 30 issues an output start instruction of magenta image data to the image controller 40 (step S408). At the same time, the engine controller 41 notifies the printer control unit 42 of the start of magenta image formation. For the subsequent color cyan, the same processes are executed.

As described above, when full-color image formations are continuously made on a plurality of print sheets, they can be continued without being synchronized with one revolution of the transfer belt 110 by re-storing the value of the timer 1 at the time of yellow image formation. Hence, sheet intervals can be reduced, and the productivity of the image forming apparatus can be consequently improved.

This embodiment has given the description including the scanner phase control. However, this embodiment is also applicable to an image forming apparatus, which does not execute any scanner phase correction. In this case, if the engine controller 41 determines in step S412 that the timer 2 has exceeded the aforementioned predetermined time, the process advances to step S405. In step S405, the printer control unit 42 stores the elapsed time T1' timed by the timer 1 since reception of the transfer belt reference signal 10 in the memory 17 again (step S405). Next, the scanner control unit 30 issues an output start instruction of yellow image data to the image controller 40 without transmitting any phase control start instruction signal 8 and without waiting for an elapse of the scanner phase correction completion time T5 (step S408). As a result, the yellow image data output start timing is reached by omitting the waiting time for an elapse of the time T5, and image data output start control processes for the subsequent colors, that is, magenta, cyan, and black are executed by omitting the waiting time for an elapse of the time T5 as in yellow.

<Modification>

Furthermore, the sequence of this embodiment is also applicable to an image forming apparatus, which detects a reference position of the transfer belt 110 after completion of the initial processes, and starts image formation after an elapse of a predetermined time period since detection of the reference position of the transfer belt 110. More specifically, the printer control unit 42 determines in step S404 whether or not the initial processes are complete. At this time, the timer 1 activation processing has already been started. If it is determined that the initial processes are complete, the printer control unit 42 then determines whether or not the reference position of the transfer belt 110 has been detected (not shown in FIGS. 14A to 14C). If the printer control unit 42 determines that the reference position of the transfer belt 110 has been detected, the process can advance to step S405. Then, the elapsed time of the timer 1 when the control reaches step S405 and that stored in step S405 are zero, and a yellow phase control start instruction 8 is transmitted. After magenta, every time the reference position of the transfer belt 110 is detected, the phase control start instruction 8 is transmitted. Then, when the flowchart shown in FIGS. 14A to 14C described above is executed, the same effects as in the fourth embodiment can be obtained.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-272800 filed on Nov. 30, 2009, and No. 2010-246745 filed Nov. 2, 2010, which are hereby incorporated by reference herein in their entirety.

What is claimed is:

1. An image forming apparatus comprising:

an image forming unit that includes a rotation member which is used for image formation, and on which a mark indicating a reference position for image formation is formed;

a detection unit configured to detect the mark on the rotation member and output one or more reference signals;

a control unit that causes the image forming unit to start a preparation processing, and then causes the image forming unit to start an image forming processing for the image of a first color in response to outputting a completion signal indicating that the preparation processing is completed; and a timing unit configured to measure, when outputting the completion signal, a time period from when the detection unit has output a first reference signal immediately before outputting the completion signal until the completion signal is outputted, wherein the control unit considers the time period measured by the timing unit as a waiting period, and causes the image forming unit to start the image forming processing for the image of subsequent colors following the first color when the waiting period has elapsed after outputting a second reference signal following the first reference signal.

2. The apparatus according to claim 1, further comprising:

a light irradiation unit;

a single image carrier on which an electrostatic latent image is formed by light irradiated by said light irradiation unit; and a plurality of developing units that respectively hold developing agents of different colors and apply the developing agents to the electrostatic latent images, wherein the rotation member is an intermediate transfer member on which developing agent images developed on said single image carrier by said plurality of developing units are transferred, wherein said control unit controls said light irradiation unit to perform light irradiation according to image data when the image formation operation is ready to begin, and when the second reference signal is outputted, said control unit further controls said light irradiation unit to perform light irradiation according to image data of the subsequent color after the waiting process based on the waiting period measured by said timing unit.

3. The apparatus according to claim 2, wherein said light irradiation unit emits a light beam based on an image, and said apparatus further comprises:

a rotating polygonal mirror that deflects and scans the light beam emitted by said light irradiation unit in synchronism with a main scanning synchronization signal;

an initial operation unit that executes the preparation processing of preparing to execute the image formation operation; and a correction unit that corrects a phase of the main scanning synchronization signal with respect to the first reference signal for a first color by controlling a rotational phase of said rotating polygonal mirror after the preparation processing by said initial operation unit is completed, wherein when the second reference signal for the subsequent color is outputted, said control unit performs a waiting process based on a time required until phase correction of the main scanning synchronization signal is completed, where the time is measured by said timing unit as the waiting period required until the image forming unit completes the preparation processing.

4. The apparatus according to claim 3, further comprising:

a synchronization signal output unit that outputs the main scanning synchronization signal in response to detection of the light beam scanned by said rotating polygonal mirror, wherein said correction unit outputs a correction signal required to correct the main scanning synchronization signal with reference to an output timing of the first reference signal and in a predetermined period, and said correction unit controls the rotational phase of said rotating polygonal mirror so that an output timing of the main scanning synchronization signal matches an output timing of the correction signal.

5. The apparatus according to claim 4, wherein said correction unit comprises a plurality of output units that output the correction signal, and the output units are shared by a plurality of developing colors.

6. The apparatus according to claim 3, further comprising:

a synchronization signal output unit that outputs the main scanning synchronization signal in response to detection of the light beam scanned by said rotating polygonal mirror, wherein said timing unit measures another time period from after the first reference signal is outputted until the preparation processing is completed, said correction unit outputs a correction signal required to correct the main scanning synchronization signal with reference to the elapsed timing of the another time period after the first reference signal is output until the preparation processing is completed and at a predetermined period, and said correction unit controls the rotational phase of said rotating polygonal mirror so that an output timing of the main scanning synchronization signal matches an output timing of the correction signal.

7. The apparatus according to claim 2, wherein said light irradiation unit is a light emitting array on which a plurality of light emitting elements are arranged along a rotational axis direction of said single image carrier.

8. The apparatus according to claim 2, wherein each of said plurality of developing units is arranged along said single image carrier.

9. The apparatus according to claim 1, wherein said control unit controls said image forming unit to execute an image formation of a first color of a page next to a page which currently undergoes an image formation of a last color after the image formation of the page of the last color is started before the rotation member makes one revolution, and corrects the measured time period.

10. The apparatus according to claim 1, wherein the preparation processing is an initial processing of the image forming unit.

11. The apparatus according to claim 1, wherein the waiting period is a period in which the image forming unit does not start the image formation.

12. The apparatus according to claim 1, wherein the waiting period is a period in which a phase correction of a scanner is not performed.

13. The apparatus according to claim 1, wherein the preparation processing includes at least one of an initial rotation control for moving each developer in a rotary developer holding unit to a predetermined position, an activation control of a polygon mirror, an activation control of a photosensitive drum, an activation control of a transfer belt, a temperature adjustment control of a fixing device, a voltage application control to the photosensitive drum, and a transfer voltage control to the transfer belt.

14. The apparatus according to claim 1, wherein the time period from when the detection unit has output the first reference signal until the completion signal is outputted varies each time the preparation processing is executed.

15. An image forming apparatus comprising:

an image forming unit that includes a rotation member which is used for image formation, on which a mark indicating a reference position for image formation is formed;

a detection unit configured to detect the mark on the rotation member and output one or more reference signals;

a control unit that causes the image forming unit to start a preparation processing so that the image forming unit forms an image of a first color, and causes said image forming unit to form the image of a first color after a time period has elapsed, the time period including a) a time period from when a first reference signal is outputted by detecting the mark during the preparation processing until the preparation processing is completed and b) a time period from when the preparation processing is completed until a correction processing of a light irradiating unit is completed after the preparation processing is completed; and a timing unit configured to measure a time period from when the detection unit has output the first reference signal until the preparation processing is completed, wherein the control unit considers the time period measured by the timing unit as a waiting period, and controls the light irradiating unit so that the light irradiating unit does not execute the correction processing during a time period from when a second reference signal following the first reference signal has been outputted until the waiting period is elapsed, and the light irradiating unit executes the correction processing after the waiting period has elapsed so that images of colors following the first color are formed.

* * * * *